US007347774B2

(12) United States Patent
Aronstam et al.

(10) Patent No.: US 7,347,774 B2
(45) Date of Patent: Mar. 25, 2008

(54) REMOTE AUTONOMOUS INTELLIGENT AIR FLOW CONTROL SYSTEM AND NETWORK

(75) Inventors: Peter S. Aronstam, 5930 Solar Point La., Houston, TX (US) 77041; Charles Saron Knobloch, Katy, TX (US)

(73) Assignee: Peter S. Aronstam, Houston, TX (US)

( * ) Notice: Subject to any disclaimer, the term of this patent is extended or adjusted under 35 U.S.C. 154(b) by 273 days.

(21) Appl. No.: 10/987,476

(22) Filed: Nov. 12, 2004

(65) Prior Publication Data

US 2006/0105697 A1 May 18, 2006

(51) Int. Cl.
*F24F 7/06* (2006.01)

(52) U.S. Cl. ..... 454/258; 236/49.3

(58) Field of Classification Search ..... 454/256, 454/258, 306; 236/1 C, 1 R, 49.3, 51
See application file for complete search history.

(56) References Cited

U.S. PATENT DOCUMENTS 5,271,558 A * 12/1993 Hampton ..... 236/49.3
5,364,304 A 11/1994 Hampton
5,413,278 A * 5/1995 Erikson ..... 236/49.3
5,449,112 A 9/1995 Heitman et al.
5,520,328 A * 5/1996 Bujak, Jr. ..... 236/44 A
5,533,668 A 7/1996 Erikson
5,704,545 A * 1/1998 Sweitzer, Jr. ..... 237/8 R
5,913,890 A * 6/1999 Lee et al. ..... 62/186
5,927,599 A 7/1999 Kath
6,338,677 B1 1/2002 White
6,364,211 B1 4/2002 Saleh
6,491,094 B2 * 12/2002 Rayburn et al. ..... 165/250
6,659,359 B2 12/2003 Kwak
6,692,349 B1 2/2004 Brinkerhoff
6,798,341 B1 9/2004 Eckel
7,014,124 B2 * 3/2006 Gottlieb ..... 236/49.3
2002/0058473 A1 5/2002 Park
2004/0182941 A1 9/2004 Alles
2004/0194484 A1 10/2004 Zou
2004/0238653 A1 12/2004 Alles
2005/0127196 A1 6/2005 Gottlieb
2005/0161517 A1 7/2005 Helt et al.

OTHER PUBLICATIONS

Cynthia M. Davis, Editor; "Zoning"; Home Electronic Ideas; Winter 2004; pp. 122-124; vol. 02 No. 04; EH Publishing Inc.; Framingham, Mass.
EH Publishing Inc.; "Electronic home Magazine—Climate Control"; website-webpage www.electronichouse.com; 2004; EH Publishing Inc.; Framingham, Mass.
Suncourt Inc.; "Equalizer® EQ2 Register Booster™ Fan"; website-webpage www.suncourt.com/EQ2.html; 2004; Suncourt Inc.; Durant, Iowa.

* cited by examiner

*Primary Examiner*—Gregory Wilson
(74) *Attorney, Agent, or Firm*—Patterson & Sheridan, LLP

(57) ABSTRACT

The present invention provides one or more autonomous in-duct or register grill mounted flow control devices, each of which has the capability to restrict or boost air flow through the duct or vent to which it is attached. The individual flow control devices may be in communication with other flow control devices in the duct works, having an ability to adapt in a cooperative fashion to optimize the environment served by the ductwork. In a preferred embodiment, each of the flow control devices provides its own power and does not require changing the existing ductwork or register boxes for installation.

57 Claims, 21 Drawing Sheets

REMOTE AUTONOMOUS INTELLIGENT AIR FLOW CONTROL SYSTEM AND NETWORK

FIELD OF THE INVENTION

The present invention relates generally to the control of fluid movement through a duct or conduit. More particularly, the present invention relates to the use of one or more autonomous flow control devices, able to operate independently of an existing environmental control system.

BACKGROUND OF THE INVENTION

The typical air vents in commercial and residential settings consist of louvers which may be manually opened or closed in varying degrees. These air vents provide a limited ability to adjust the amount of air flow into a room or area, the air coming from a central environmental control unit, such as a furnace, central air conditioner, or dehumidifier. There may be several such vents connected, via ducts, to the central environmental control unit, each vent providing air flow to a room or area. Since these vents are generally connected to a central unit, the opening or closing of one or more vents affects the air flow to the other vents. If it is desired to restrict the flow of air in single area or room, then the other rooms or areas are affected. To restrict the flow to a room or area, the vent for that room or area must be manually adjusted. Furthermore, a single thermostat typically controls the operation of the environmental control unit. If that thermostat is in the room or area where the air flow is adjusted, then the temperature and climate of the other rooms or areas are affected. The temperature and climate of the other rooms or areas are affected even if the thermostat is not in the room or area were the air flow is adjusted, owing to the fact that the ratios of air flow between the remaining vents are altered by the opening or closing of any of the vents. This usually leads to the need to readjust all vents if any one of the vents is opened or closed, a process which may require several iterations to perfect, and then only for the specific conditions at the time the adjustment was made. Further, if one overly restricts airflow by closing too many vents, damage to the environmental control unit may occur.

An additional inconvenience occurs in cases where the vent to be adjusted resides in a tall ceiling. The user must climb a ladder or use a stick to open and close the vent. An additional inconvenience occurs in situations where a user wishes to open or close a vent at a certain time during the day to account for changes in solar influx or room use pattern. In one example, a user wishes to keep certain vents restricted during the night to conserve energy, such as to emphasize the vents in the sleeping quarters, and then close them during the day. A further complication occurs when a user wishes to boost the heating or cooling in a specific room. With a conventional installation, the only way to boost a given room is to restrict flow in other rooms, requiring that the user change multiple vent controls in other rooms to accomplish the users goals.

This problem has been partially addressed with various remote-controlled vent louvers. A user may install a vent louver that is powered by being wired to a source of electricity or by batteries. The remote control allows the user to point at the vent to open or close the vent. Such a configuration reduces the need for manually adjusting the vent, but either requires wiring to the mains or periodic battery replacement. A further restriction of these devices is that they can only retard flow; they cannot boost the local air flow, limiting their ability to increase cooling, heating, humidity or to control complex multi-room issues.

BRIEF SUMMARY OF THE INVENTION

What I am about to describe here is a new way to control the air flow through a duct or duct works system. The present invention provides one or more autonomous in-duct or register grill mounted flow control devices, each of which has the capability to restrict or boost air flow through the duct or vent to which it is attached. The individual flow control devices may be in communication with other flow control devices in the duct works, having an ability to adapt in a cooperative fashion to optimize the environment served by the ductwork. In a preferred embodiment, each of the flow control devices provides its own power and does not require changing the existing ductwork or register boxes for installation.

The in-duct or register grill mounted flow control devices of the present invention are inserted into the ductwork served by the environmental control unit. In a preferred embodiment, these flow control devices comprise a means to restrict flow, a means to supply power, a means to communicate and a means to provide adaptive control, enabling cooperation with other similar devices. The flow restriction provided in the present invention is a substantial improvement over previous turbine and louver designs in that it is capable of operating safely over a broader range of flow, typically up to 100%. Each flow control device has a communications means which allows it to be cognizant of the status of the other devices in the ductwork, the local environmental conditions, such as temperature or humidity, in the room it is serving, and the functional requests of the user which may be input from time to time via a remote hand held controller. The adaptive control and cooperation is provided by a series of electronic circuits, with appropriate microcontroller and drivers to activate the functions of the flow control device in accordance with functional requests entered by the user from time to time. The combination of these means gives the flow control device the capability to regulate the environment in the served room while at the same time cooperating with other devices in the ductwork to optimize meeting the functional request of the user.

In operation, when a plurality flow control devices is placed in the ducts, register boxes or on register grills a greater measure of improvement can be effected. Each flow control device collects the local environmental conditions. Each flow control device also collects its operational status and makes available through the communications means such operational status and local environmental conditions to other flow control devices, thereby creating an information matrix. Each flow control device applies its adaptive control means using the information matrix to adjust the amount of flow restriction with consideration of the other flow control devices thus maintaining the functional request of the user.

The flow control device does not need the environmental control unit to be circulating air to effect local environmental conditions. By incorporating a flow reversing means such as a fan or turbine, the flow control device is able to move air through the ductwork. In this manner if a room becomes too cold or hot, the flow control device can circulate hot or cold air out of the room towards a room capable of actuation the environmental control unit such as room with a thermostat connected to the environmental control unit.

Even in a single flow control device installation, the device with its flow reversing means is capable of providing a level of control. Monitoring its internal operational status and local environmental conditions, a flow control device can either accelerate or retard flow to meet the user's functional request.

BRIEF SUMMARY OF THE INVENTION—OBJECTS AND ADVANTAGES

It is an object of the present invention to enable a plurality of flow control devices capable of both increasing and decreasing the delivered air flow to a given room or rooms.

An advantage of the present invention is that the individual flow control devices through out the ductwork can communicate with each other providing a collective intelligence enabling of managing the interdependence of air flow on each other.

It is a further object of the present invention to enable the flow control devices to determine the best independent behavior to satisfy the overall environmental control goals.

It is a further object of the present invention to eliminate the need for a central controller or central processing unit to achieve overall environmental control goals. An advantage of this configuration is that even if one or more flow control devices fail, the remaining collective of devices adapt and continue to operate towards the overall environmental control goals. Further, if the communications means between flow control devices partially or totally fail, the flow control devices still continue to operate independently, or partially independently, towards achieving the overall environmental control goals. Thus, there is no central processing unit to cause complete system failure.

It is a further object of the present invention to have the ability to increase the local flow by either boosting flow or influencing other flow control devices in the ductwork to restrict flow.

It is a further object of the present invention to enable a flow control device to automatically adjust, regulating an area to a desired temperature.

It is a further object of the present invention to enable installation of one or more flow control devices without the need for electrical wiring, modification of the duct work or register boxes, or connecting to the environmental control unit.

An advantage of the present invention is that the user does not have to physically go to the duct or vent in order to manually adjust the vent, program new instructions or goals, or to perform battery replacement.

It is an advantage of the present invention to provide limited environmental regulation even when the environmental control unit system is in the off state.

It is an object of the present invention to enable flow restriction beyond the typical 5% to 35% range.

BRIEF DESCRIPTION OF THE SEVERAL VIEWS OF THE DRAWING

The present invention and its advantages will be better understood by referring to the following detailed description and the attached drawings in which.

REFERENCE NUMERALS IN DRAWINGS

Figure 1:
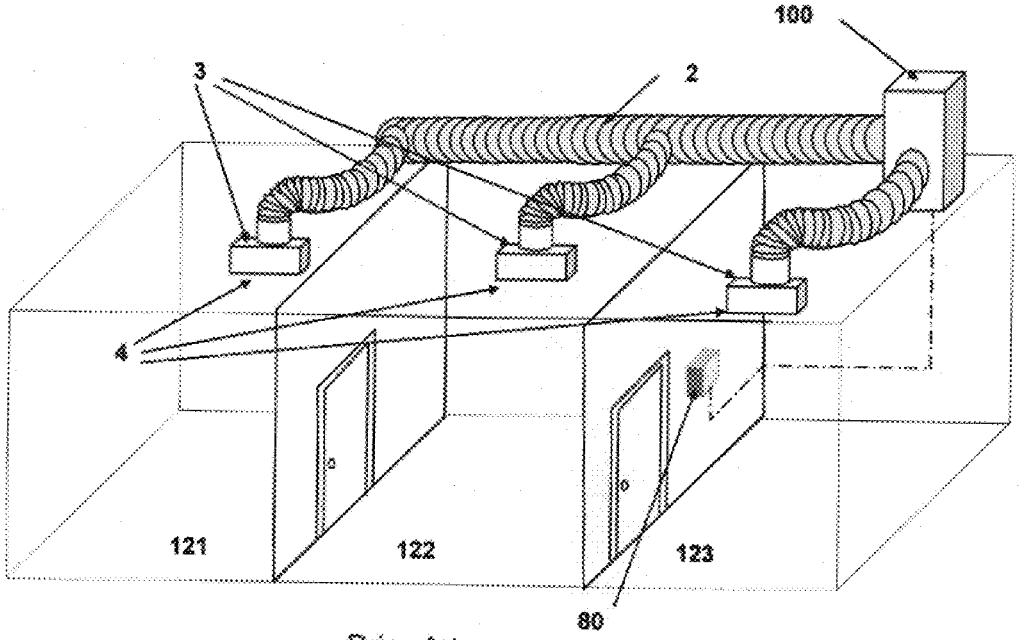
Prior Art Fig. 1
FIG. 1 shows a 3-D perspective view illustrating a typical application of an environmental control unit.

The following elements are numbered as described in the drawings and detailed description of the invention:

| | |
|---|---|
| 1 | air flow |
| 2 | ductwork |
| 2a, 2b, 2c | ductwork branches |
| 3 | register box |
| 4, 4a, 4b, 4c | register grill |
| 5, 5a, 5b, 5c | flow control device |
| 7 | Adjustable size bracket |
| 6 | grill mounting bracket |
| 8, 8a, 8b, 8c | sensor |
| 8' | sensor-network module |
| 9 | AC line network |
| 9' | network |
| 10, 10' | rotating structure |
| 11 | petal valve bracket |
| 12 | network interface |
| 21 | switch plate |
| 22 | wall |
| 23 | electrical box |
| 30 | power storage |
| 31, 31" | motor-dynamo |
| 33, 33" | motor-dynamo bus |
| 35 | power manager |
| 36, 36" | load controller |
| 37 | power regulator |
| 38 | power source |
| 39 | power bus |
| 40 | communications device |
| 41 | communications driver |
| 42 | remote programming unit |
| 43 | remote polling unit |
| 44 | sensor communications device |
| 36, 36" | load controller |
| 37 | power regulator |
| 38 | power source |
| 39 | power bus |
| 40 | communications device |
| 41 | communications driver |
| 42 | remote programming unit |
| 43 | remote polling unit |
| 44 | sensor communications device |
| 50 | microcontroller |
| 51 | sensor microcontroller |
| 52 | analog to digital converter |
| 54 | temperature sensor |
| 55 | room temperature sensor |
| 56 | room proximity sensor |
| 57 | room humidity sensor |
| 60 | petal valve |
| 62 | flow restriction control |
| 64 | Stepper motor |
| 70, 70', 70" | intelligent controller |
| 71 | intelligent controller housing |
| 80, 80' | central controller |
| 100 | environmental control unit |
| 101, 101a, 101b, 101c | operational status |
| 102, 102a, 102b, 102c | environmental status table |
| 103 | remote program instructions |
| 104 | environmental control unit command |
| 105 | requested parameters |
| 121, 122, 123 | rooms |
| 441 | infra-red photo diode |
| 442 | infra-red LED |
| 443 | driver |
| 1201 | AC Modem |

DETAILED DESCRIPTION OF THE INVENTION

The common configuration for environmental control in use today is shown in FIG. 1. Environmental control unit 100 delivers heated or cooled air through ductwork 2 into rooms 121, 122, 123. Ductwork 2 can be any system of conduits capable of transferring conditioned air from an environmental control unit to rooms. Rooms 121, 122, 123 can be any space or zone where environmental control is desired. Environmental control unit 100 can be any one of a number of devices such as a HVAC unit a dehumidifier, and furnace, evaporative cooling unit or other such air conditioning device. Central controller 80, as show by example to be located in room 123, regulates the operation of environmental control unit 100. Central controller 80 can be a thermostat, humidity controller, timer, or any of many devices typical of controlling an environmental control unit. An inhabitant of room 123 with the central controller 80 enjoys a measure of comfort due to the proximity of central controller 80, however any inhabitants of the other rooms 121, 123 are subject to the variations caused by differing environmental sources or conditions which are not sensed by central controller 80. If for example, an inhabitant of room 121 has afternoon sun heating room 121, then room 121 will be substantially hotter than the temperature set on central controller 80. This illustrates the problem addressed by the present invention.

Figure 2:
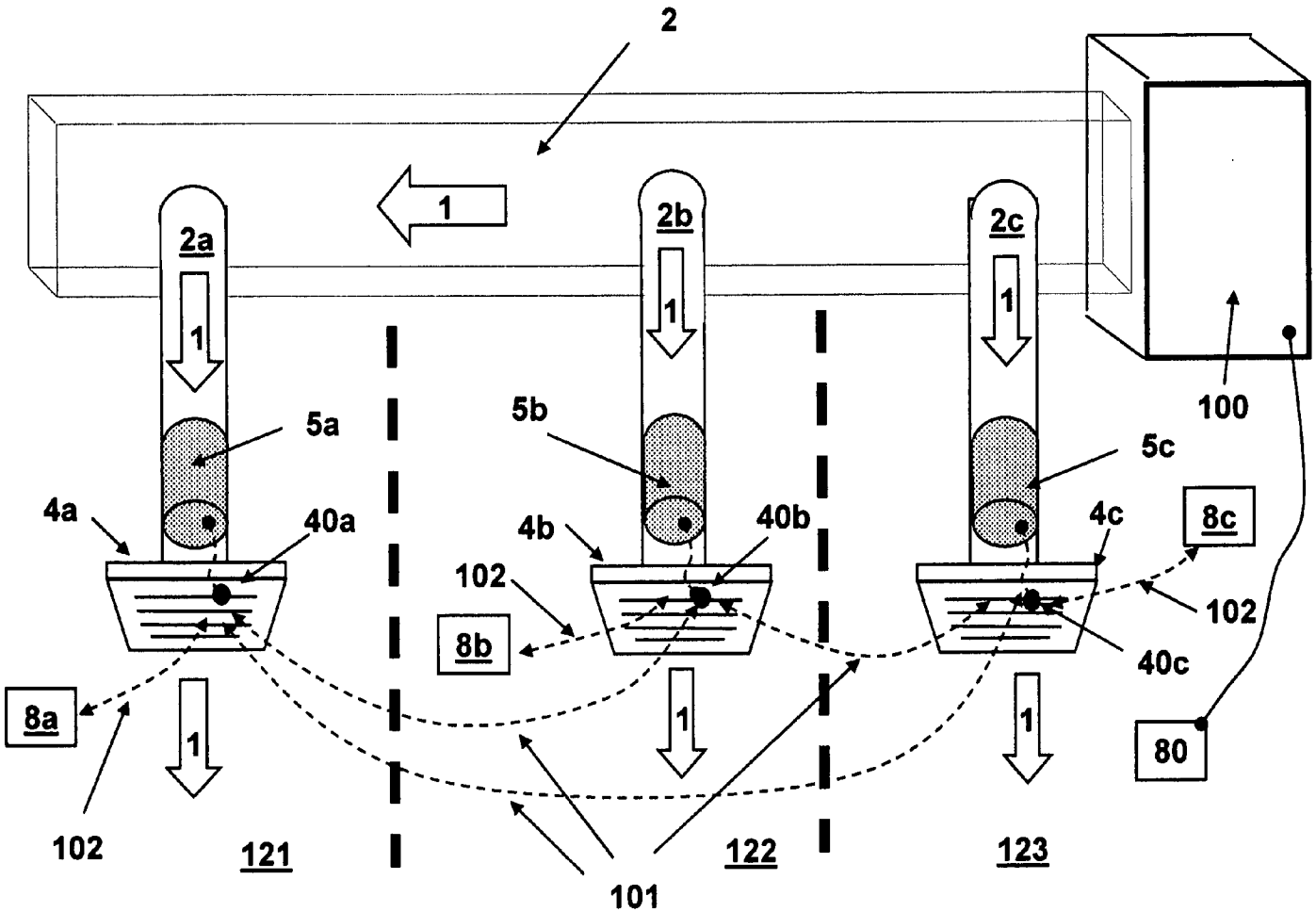
FIG. 2 shows a diagrammatic view illustrating the present invention in the context of a typical application.

FIG. 2 illustrates the present invention as installed in a typical configuration. Environmental control unit 100 is connected to ductwork 2. Ductwork branches 2*a*, 2*b*, 2*c* extend from ductwork 2 to one or more rooms 121, 122, 123. Central controller 80 may be placed in one room 123, and is in communication with environmental control unit 100. One or more flow control devices 5*a*, 5*b*. 5*c* are installed in respective ductwork branches 2*a*, 2*b*, 2*c*. Register grills 4*a*, 4*b*, 4*c* attach to the termination of ductwork branches 2*a*, 2*b*, 2*c* respectively. Flow control devices may be installed as shown within the ductwork, ductwork branches or alternatively installed at the termination of the ductwork branches. Communications devices 40*a*, 40*b*, 40*c* are mounted on register grills 4*a*, 4*b*, 4*c* respectively and electrically connected to respective flow control devices 5*a*, 5*b*, 5*c*. Communications devices may be any typical wireless or wired system using infra red, 802.11 spread spectrum, digital cable, RS-232, modem, AC line network, ultrasonic, x10, Zigbee, Bluetooth, instrumentation bus, or other wire or wireless methods and protocols, and any combination thereof. These communications means may also include use of one or more relays to move information through out the installation. Sensors 8*a*, 8*b*, 8*c* are located within rooms 121, 122, 123 and are in communication with communications devices 40*a*, 40*b*, 40*c*. Sensors 8*a*, 8*b*, 8*c* capture the rooms' environmental condition which may include temperature, humidity, date, day, time of day, use, proximity of inhabitants, or user desired environmental condition, such as desired temperature. Environmental status tables 102*a*, 102*b*, 102*c* are passed from sensors 8*a*, 8*b*, 8*c* to the flow control devices 5*a*, 5*b*, 5*c* by way of the communications devices 40*a*, 40*b*, 40*c* respectively. Environmental status tables contain summaries of all data collected by the sensors regarding the environmental condition of the room. Operational status tables 101 may be passed amongst flow control devices 5*a*, 5*b*, 5*c* by way of communications devices 40*a*, 40*b*, 40*c*. The operational status table may be any combination of data regarding the current operating status, internal workings of the flow control devices, or local environmental conditions and will be described further in subsequent paragraphs.

Figure 3:
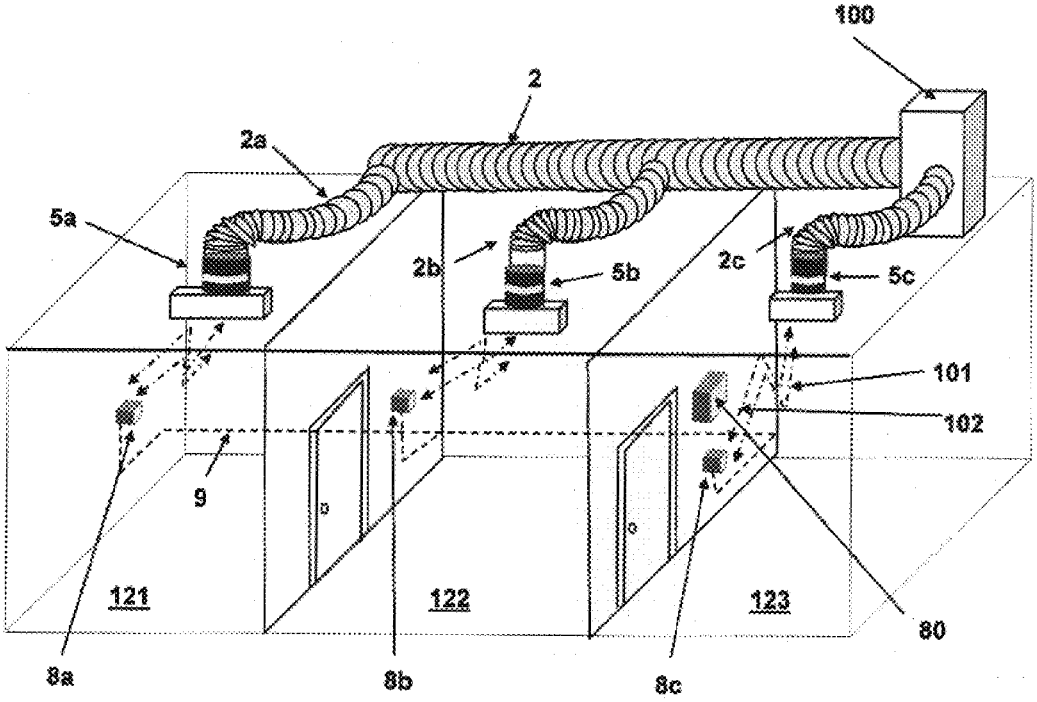
FIG. 3 shows a 3-D perspective view illustrating the use of sensors 8 and positioning of flow control devices 5.

FIG. 3 illustrates an alternate embodiment of the communications means. Operations status tables 101 may be passed amongst flow control devices by way of sensor 8*a*, 8*b*, and 8*c*. This is accomplished by connecting sensors 8*a*, 8*b*, 8*c* to AC line network 9, as is detailed in FIG. 11 and FIGS. 16, 17, and 18. An AC line network uses the existing AC distribution wiring to allow communications. This is accomplished using various technologies such as AC modems or X10.

Figure 4:
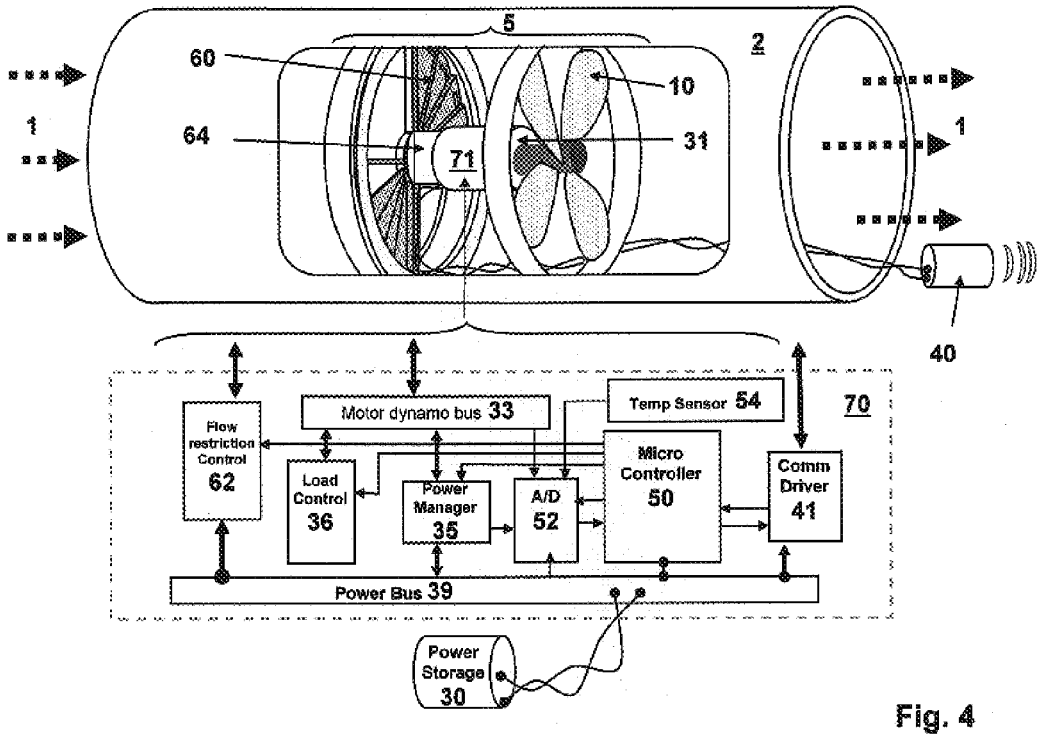
FIG. 4 shows a 3-D perspective view illustrating flow control device 5 as installed in ductwork 2 with a schematic view of intelligent controller 70.

FIG. 4 is a detailed illustration of the flow control device 5 as mounted in duct 2. Flow control device contains rotating structure 10. Rotating structure 10 can be a propeller, turbine or any structure which is capable of being moved by the air flow passing through the unit. Rotating structure 10 is axially connected to motor-dynamo 31. The motor dynamo is a brush, or brushless motor or any device providing the means of generating power and driving the rotating structure. The combination of the rotating structure and the motor dynamo provides the flow control device with the means to generate power, means to boost flow and a means to restrict flow. Motor-dynamo 31 is axially connected to intelligent controller housing 71. Stepper motor 64 is axially connected to intelligent controller housing 71. The stepper motor 64 can be any device capable of actuating an additional flow restricting device. The stepper motor 64 is axially connected to Petal valve 60. Petal valve 60 could be any valve structure capable of reducing flow though flow control device 5. Petal valve provides additional means of flow restriction. These means to restrict flow enable various intermediate values between full open and full closed, allowing partial restriction of air flow through the duct. The whole assemblage of flow control device 5 is firmly fit within duct 2.

Within intelligent controller housing 71 are located intelligent controller 70 and power storage 30. Communications device 40 is connected by wires to intelligent controller 70, and is situated preferably downstream of flow control device 5. Flow control device is preferably oriented such that petal valve 60 is located upstream of rotating structure 10. Intelligent controller 70 comprises multiple electrical subsystems providing the means to adaptively control flow in duct 2. Intelligent controller 70 is typically a printed circuit card or integrated electronic chip. Motor dynamo 31 is electrically connected to motor dynamo bus 33 of intelligent controller 70. The Motor dynamo bus 33 allows multiple circuit subsystems to transfer electrical energy to or from the motor dynamo as required for proper functioning. Motor dynamo bus 33 is electrically connected to Power manager 35. Power manager 35 is electrically connected to power bus 39. Power bus 39 is connected to power storage 30. The power manager acts as a bi-directional switch and power regulator between the motor dynamo bus 33 and the power bus 39. The power bus 39 provides a delivery conduit for electrical energy to all circuit subsystems in intelligent controller 70. Alternatively the circuit subsystems may be powered by independent means. Stepper motor 64 is electrically connected to flow restriction control 62. The flow restriction control 62 is electrically connected to power bus 39. The flow restriction control controls the flow of electrical energy to stepper motor 64, actuating petal valve 60. Communications device 40 is electrically connected to communications driver 41. Communications driver 41 is electrically connected to power bus 39. Power bus 39 is electrically connected to the microcontroller 50. Microcontroller 50 is logically connected to and controls the operation of Communications driver 41. Communications driver 41 manages the data sent to or received from communications device 40. Microcontroller 50 is logically connected to and controls the operation of flow restriction control 62. Microcontroller 50 is logically connected to and controls the operation of load control 36. Microcontroller 50 is logically connected to and controls the operation of power manager 35. Microcontroller 50 is logically connected to and controls the operation of analog to digital converter 52. The analog to digital converter returns data to the microcontroller 50. Analog to digital converter 52 receives a data signal from temperature sensor 54 indicating the current temperature of the air in duct 2. Analog to digital converter receives a data signal from power bus 39 representing the charge level of the power storage 30. Analog to digital converter 52 receives a data signal from power manager 35. Analog to digital converter 52 receives a data signal from motor dynamo bus 33 indicative of the flow in duct 2. Alternatively analog to digital converter 52 function could be distributed into the various circuit subsystems allowing digital signals to be presented directly to micro controller 50.

Figure 5:
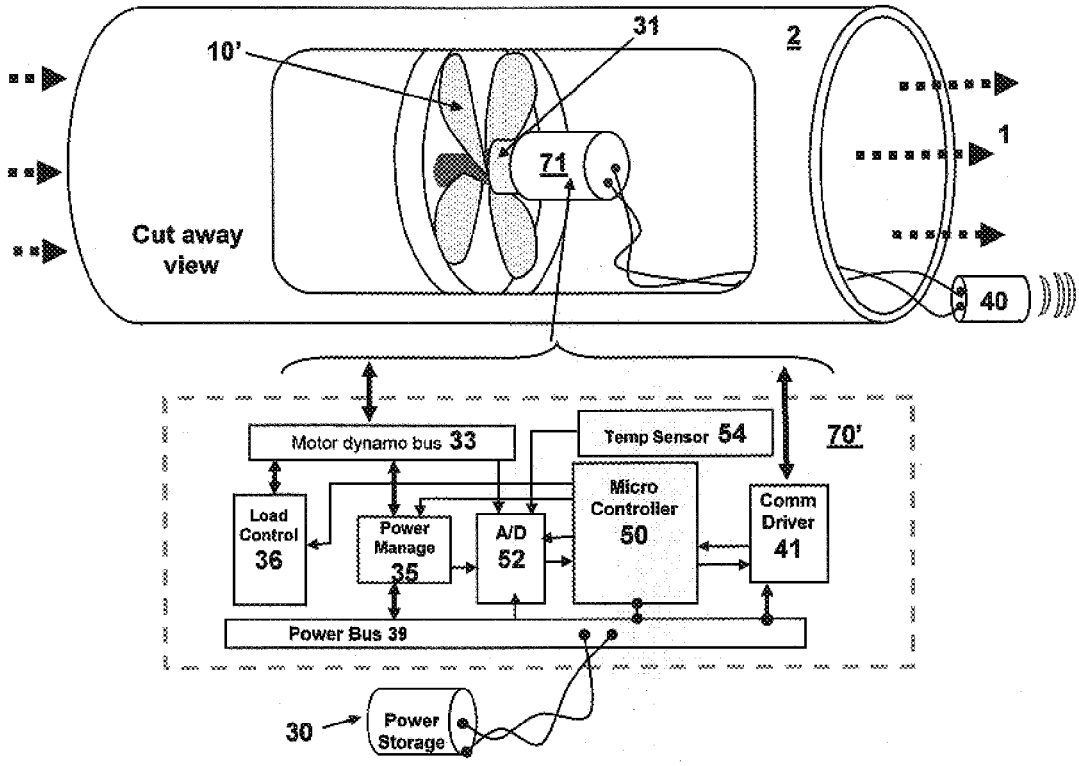
FIG. 5 shows a 3-D perspective view illustrating a single-fan embodiment of flow control device 5 as installed in ductwork 2 with a schematic view of intelligent controller 70'.

FIG. 5 is a detailed illustration of an alternate of embodiment flow control device 5. Flow control means is implemented with a single rotating structure 10'. Rotating structure 10 can be a propeller, turbine or any structure which is capable of being moved by the air flow passing through the unit. The rotating structure serves as both a power generation means and as the flow control means in the embodiment. Rotating structure 10 is axially connected to motor-dynamo 31. The motor dynamo is a brush, or brushless motor or any device providing the means of generating power and driving the rotating structure. The combination of the rotating structure and the motor dynamo provides the flow control device with the means to generate power, means to boost flow and a means to restrict flow. Motor-dynamo 31 is axially connected to intelligent controller housing 71. Within intelligent controller housing 71 are located intelligent controller 70' and power storage 30. Communications device 40 is connected by wires to intelligent controller 70, and is situated preferably downstream of flow control device 5. Intelligent controller 70' comprises multiple electrical subsystems providing the means to adaptively control flow in duct 2. Intelligent controller 70 is typically a printed circuit card or integrated electronic chip. Motor dynamo 31 is electrically connected to motor dynamo bus 33 of intelligent controller 70'. The Motor dynamo bus 33 allows multiple circuit subsystems to transfer electrical energy to or from the motor dynamo as required for proper functioning. Motor dynamo bus 33 is electrically connected to Power manager 35. Power manager 35 is electrically connected to power bus 39. Power bus 39 is connected to power storage 30. The power manager acts as a bi-directional switch and power regulator between the motor dynamo bus 33 and the power bus 39. The power bus 39 provides a delivery conduit for electrical energy to all circuit subsystems in intelligent controller 70'. Alternatively the circuit subsystems may be powered by independent means. Communications device 40 is electrically connected to communications driver 41. Communications driver 41 is electrically connected to power bus 39. Power bus 39 is electrically connected to the microcontroller 50. Microcontroller 50 is logically connected to and controls the operation of Communications driver 41. Communications driver 41 manages the data sent to or received from communications device 40. Microcontroller 50 is logically connected to and controls the operation of load control 36. Microcontroller 50 is logically connected to and controls the operation of power manager 35. Microcontroller 50 is logically connected to and controls the operation of analog to digital converter 52. The analog to digital converter returns data to the microcontroller 50. Analog to digital converter 52 receives a data signal from temperature sensor 54 indicating the current temperature of the air in duct 2. Analog to digital converter receives a data signal from power bus 39 representing the charge level of the power storage 30. Analog to digital converter 52 receives a data signal from power manager 35. Analog to digital converter 52 receives a data signal from motor dynamo bus 33 indicative of the flow in duct 2. Alternatively analog to digital converter 52 function could be distributed into the various circuit subsystems allowing digital signals to be presented directly to micro controller 50.

Figure 6:
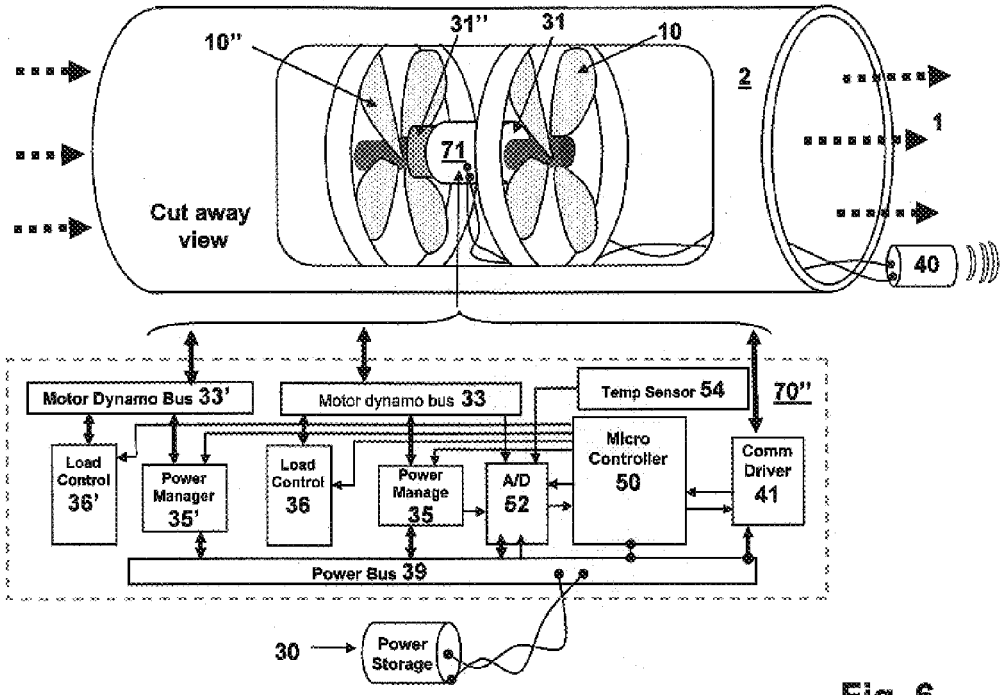
FIG. 6 shows a 3-D perspective view illustrating a multi-fan embodiment of flow control device 5 as installed in ductwork 2 with a schematic view of intelligent controller 70"

FIG. 6 is a detailed illustration of another alternate embodiment flow control device 5 as mounted in duct 2. Flow control device contains rotating structure 10. Rotating structure 10 can be a propeller, turbine or any structure which is capable of being moved by the air flow passing through the unit. Rotating structure 10 is axially connected to motor-dynamo 31. The motor dynamo is a brush, or brushless motor or any device providing the means of generating power and driving the rotating structure. The combination of the rotating structure and the motor dynamo provides the flow control device with the means to generate power, means to boost flow and a means to restrict flow. Motor-dynamo 31 is axially connected to intelligent controller housing 71. A second rotating structure 10" is axially connected to intelligent controller housing 71. Rotating structure 10" can be a propeller, turbine or any structure which is capable of being moved by the air flow passing through the unit. Here an active flow restriction means is used in conjunction with the fan/generator to control the amount of flow through the duct. Either of the rotating structures 10 or 10" can be switched between generating and obstructing functions, or the two in combination, by independent power managers 35 and 35' and load controls 36 and 36' under the supervision of microcontroller 50, all contained within intelligent controller 70". Rotating structures 10 and 10" can also be driven by current from electrical energy stored in power storage 30 by way of independent power managers 35 and independent buses 33 and 33'. Alternately the rotating structures 10 and 10" can be rotated such that each is out of phase with other to cause controllable flow restriction. The multiple rotating structures of this embodiment have the advantage of preventing the complete closure of all vents, which may lead to damage of the central blower of the heating or cooling unit, while also enabling infinitely variable settings other than just open and closed. Although FIG. 9 only represents two rotating structural elements, one can envision a larger number of devices to either increase generation or improve restriction of the unit.

Figure 7:
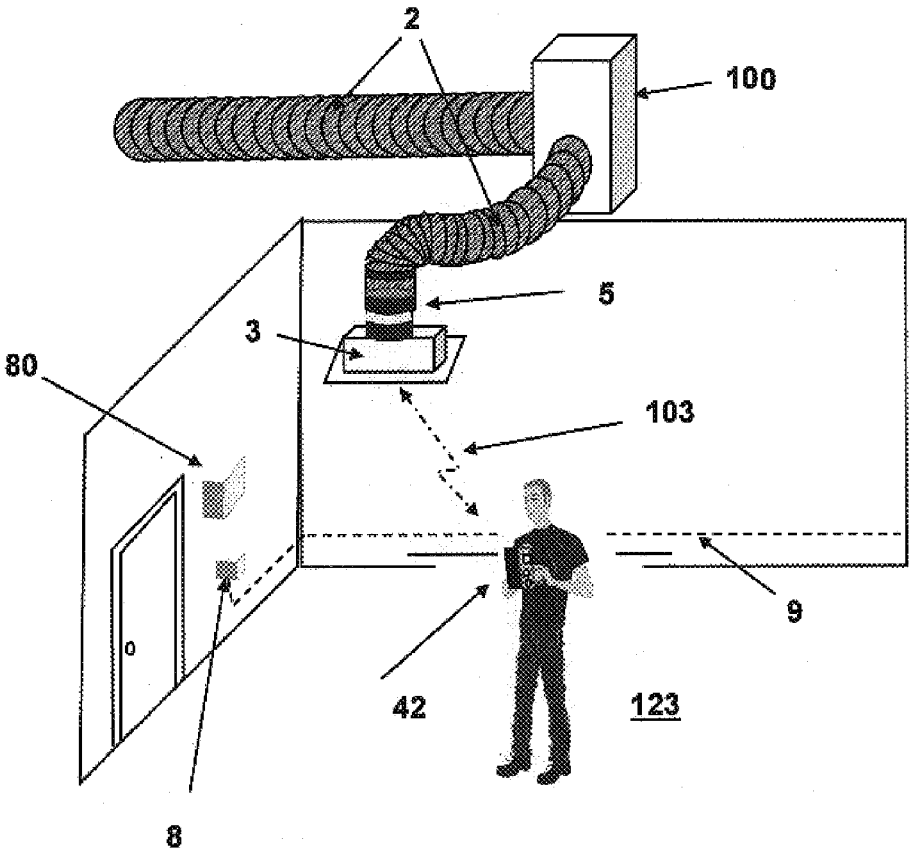
FIG. 7 shows a 3-D perspective view illustrating use of remote programming device 42 to change programming instructions in flow control device 5.

Each of the flow control devices behaves according to preprogrammed instructions in microcontroller 50. Many of these scenarios or behaviors are programmed in on manufacture and only need to be selected by the user; others may require uploading by the user. FIG. 7 shows a user using a remote programming device 42 to transmit remote program instructions 103 to flow control device 5 in room 123. This method could also be used to select the target operating environmental conditions the user wishes to maintain. Alternately, input of the functional requests of the user can be built in to sensor unit 8.

Figure 8:
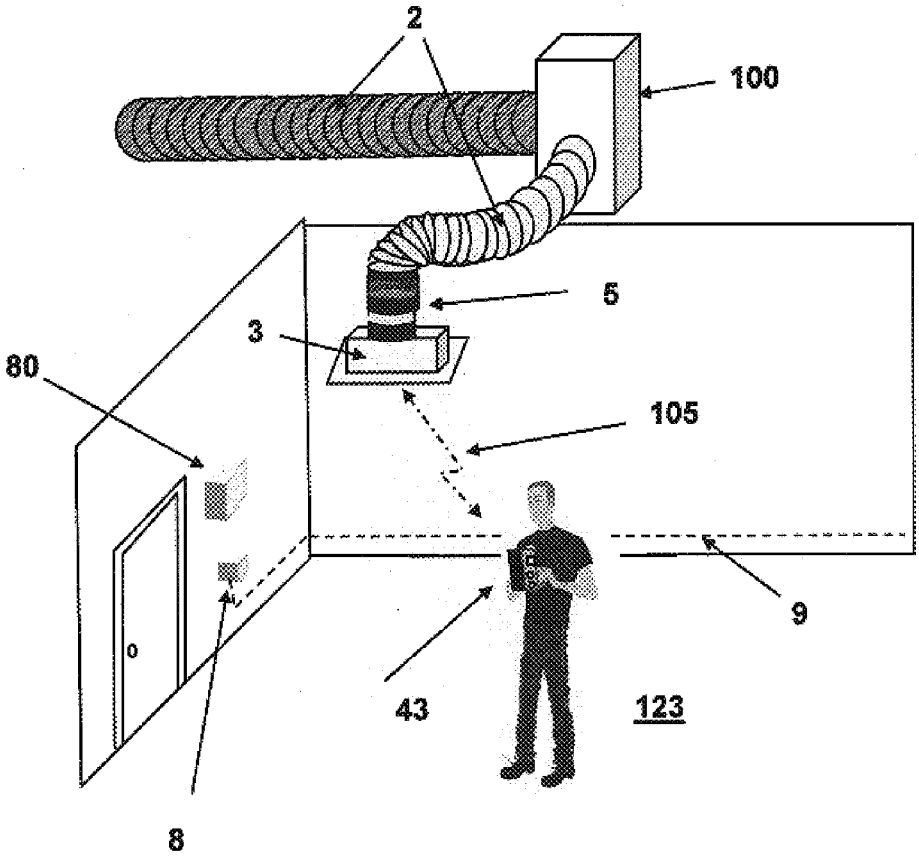
FIG. 8 shows a 3-D perspective view illustrating use of remote polling unit 43 to extract parameters from flow control device 5.

In an alternate embodiment, illustrated in FIG. 8, the means to communicate, such as communications device 40, further comprises a polling means whereby a user or technician may request one or more parameters from operational status table 101 and the environmental control table 102. Intelligent controller 70 sends the requested parameters 105 of operational status table 101 and the environmental control table 102 to communications device 40. Communications device 40 transmits requested parameters 105 to a remote polling unit 43. Remote polling unit 43 may additionally be used to collect requested parameters 105 periodically over time, thereby providing the ability to monitor overall performance.

In an alternate embodiment, not illustrated, the means to communicate, such as communications device 40, further comprises a status indication means to indicate operational status to the user. This may include indicating low power reserve, amount of flow restriction, amount of flow boost, failure conditions, or other parameters from operational status table 101 or environmental control table 102. The means to communicate may be transmitted in a wide variety of ways, typically as data through a wireless transceiver or indicated by lighting a light emitting diode, which can be seen at register grill 4.

Figure 9:
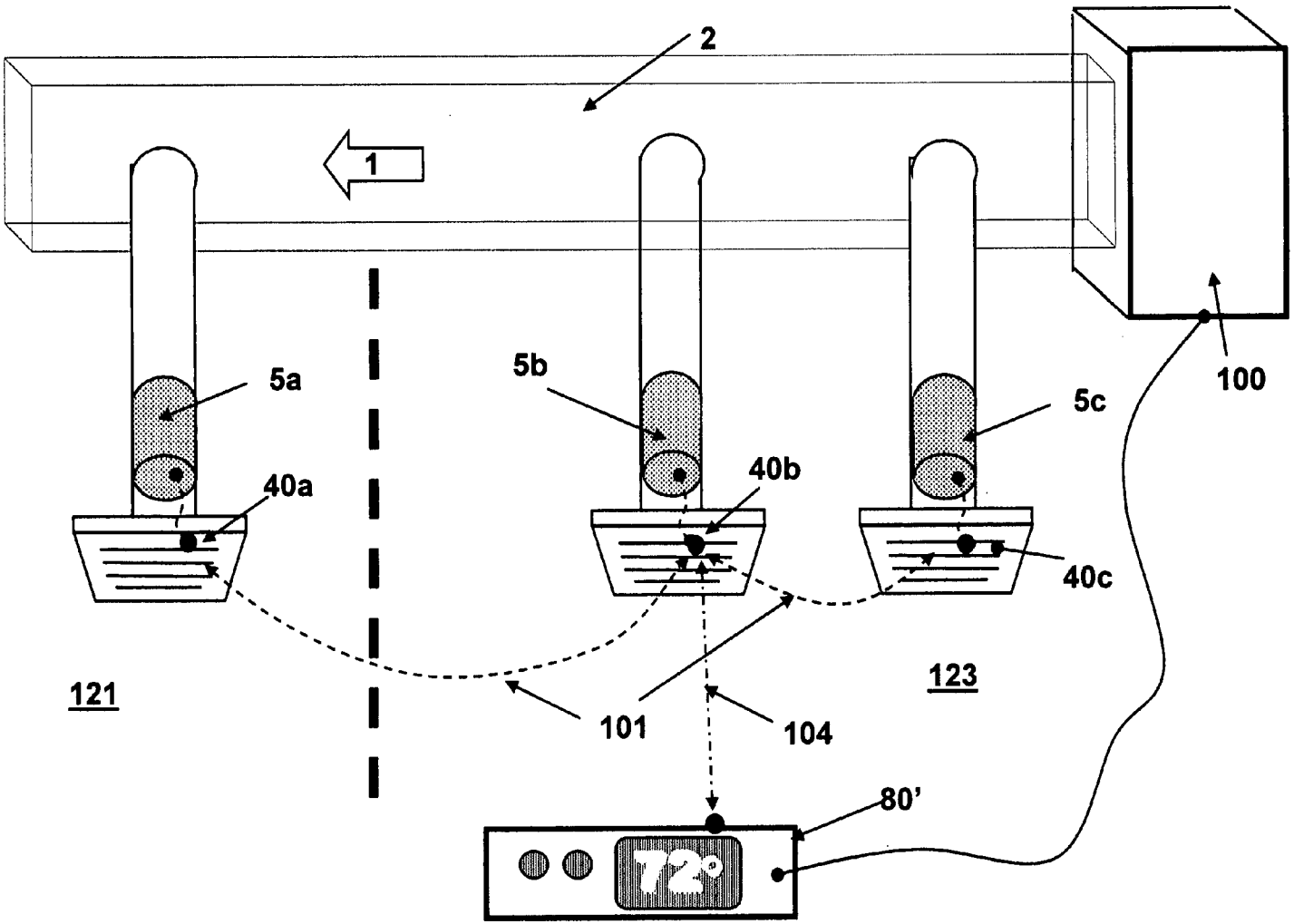
FIG. 9 shows a diagrammatic view illustrating the present invention in the context of transmitting environmental control unit commands 104 to central controller 80'.

In an alternate embodiment, as illustrated in FIG. 9, at least one flow control device **5*b* sends an environmental control unit command to its communications device 40*b*. Communications device 40*b* transmits environmental control unit command 104, which is received by central controller 80'. Central controller 80' responds to the received environmental control unit command 104, thereby modifying the operation of environmental control unit 100**. This allows the plurality of flow control devices to effectuate a request to the environmental control unit to change states if preprogrammed conditions occur.

Figure 10:
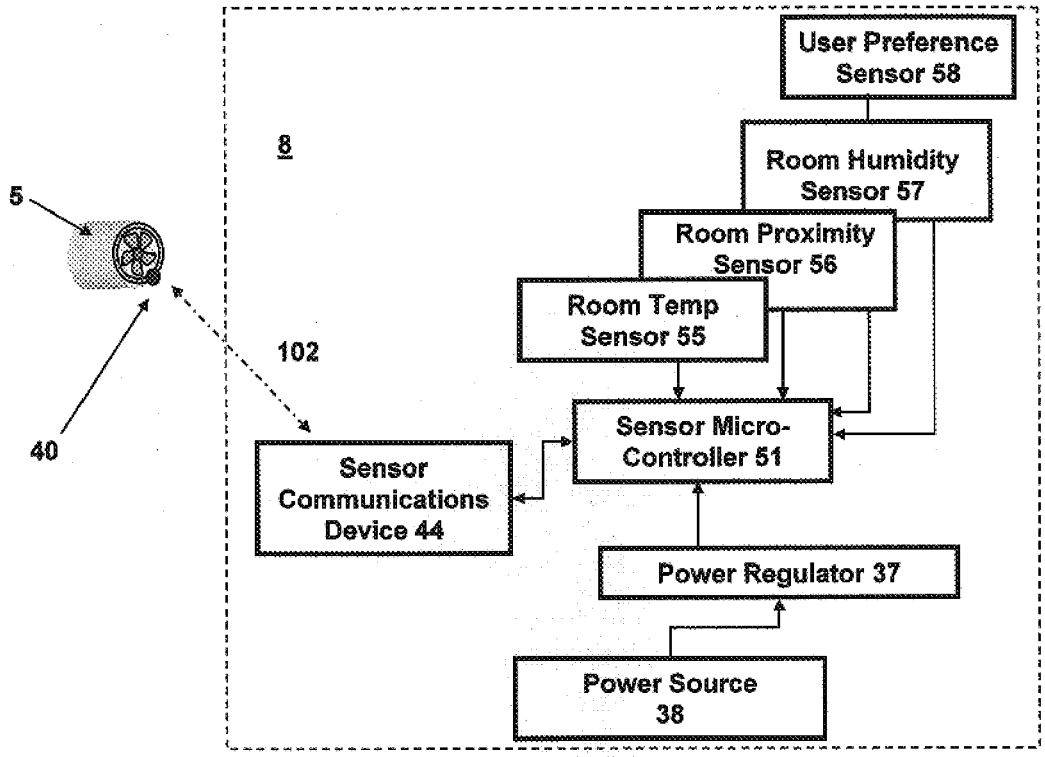
FIG. 10 shows a 3-D perspective view illustrating communications device 40 with a schematic view of sensor 8.

FIG. 10 illustrates sensor 8. Sensor 8 comprises sensor communications device 44. Sensor communications device 44 transmits environmental status table 102 to communications device 40 of a flow control device 5. Sensor communications device 44 may be any typical wireless or wired system using infra red, 802.11 spread spectrum, digital cable, RS-232, modem, AC line network, ultrasonic, X10, Zigbee, Bluetooth, instrumentation bus, or other wire or wireless methods and protocols, and any combination thereof, which is able to communicate with communications device 40. Sensor communications device 44 electrically connects to sensor microcontroller 51, which is powered by power source 38 by way of power regulator 37. Sensor microcontroller 51 is connected to one or more sensor devices, such as room temperature sensor 55, room proximity sensor 56, and room humidity sensor 57, user preference sensor 58. These various sensor devices may be based on any of a number of sensing means, such as infra-red, acoustic, resistive, semiconductor junctions, capacitive, inductive, received timing signals, switch setting, or position. A user preference sensor may be a settable thermostat, digital keypad, or other means of user input. Sensor microcontroller 51 converts the signals sensed by the various sensor devices, populating environmental status table 102 for transmission to communications device 40 by way of sensor communications device 44.

Figure 11:
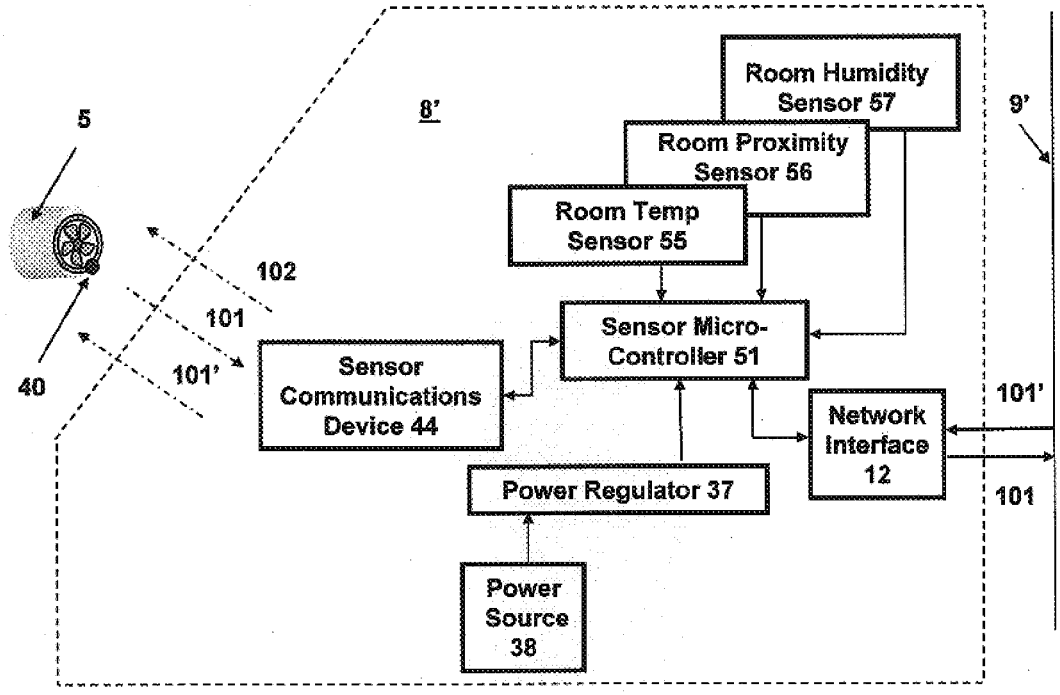
FIG. 11 shows a 3-D perspective view illustrating communications device 40 with a schematic view of sensor-network module 8', a network interface embodiment of sensor 8.

In a further alternate embodiment, the means to communicate, such as communications device 40, further comprises sensing means, such as an infra-red or laser environmental sensor capable of scanning the served room for the necessary data to fill environmental status table 102. This reduces the need for a separate sensor 8, separately installed in the room FIG. 11 illustrates sensor-network module 8', which is an alternative embodiment of sensor 8, incorporating a means to communicate operational status tables between flow control devices. Sensor-network module 8' comprises sensor communications device 44. Sensor communications device 44 transmits environmental status table 102 to communications device 40 of a flow control device 5. Flow control device 5 communicates operational status table 101 to communications device 40 which, in turn, transmits operational status table 101 to sensor communications device 44. Sensor communications device 44 electrically connects to sensor microcontroller 51, which is powered by power source 38 by way of power regulator 37. Sensor microcontroller 51 is connected to one or more sensor devices, such as room temperature sensor 55, room proximity sensor 56, and room humidity sensor 57. Sensor microcontroller 51 converts the signals sensed by the various sensor devices, populating environmental status table 102 for transmission to communications device 40 by way of sensor communications device 44.

Sensor microcontroller 51 is electrically connected to network interface 12, which is connected to network 9'. Operational status table 101 is relayed to network 9' by way of sensor microcontroller 51 and network interface 12. Network interface 12 receives operational tables 101' from other flow control devices which are in communication with network 9'. Operational status tables 101' are relayed to sensor communications device 44 by way of sensor microcontroller 51. Sensor communications device 44 transmits operational status tables 101' to flow control device 5 by way of communications device 40. This allows operational status tables 101' to be reliably sent between flow control devices via their corresponding sensor-network modules.

Method of Application

Figure 12:
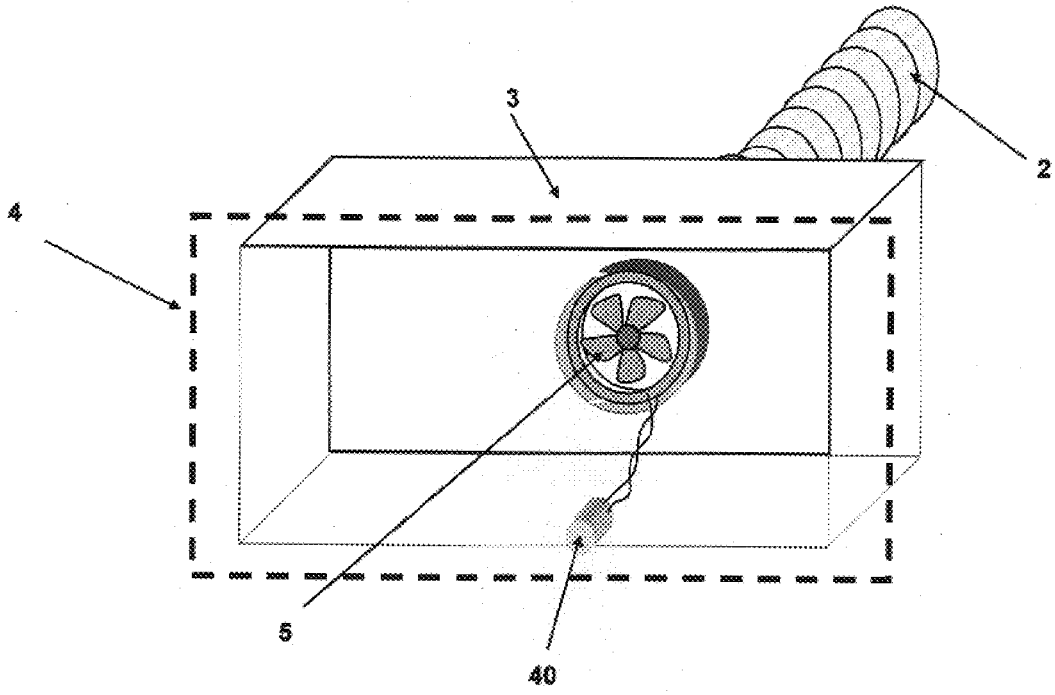
FIG. 12 shows a 3-D perspective view illustrating a method of installing the present invention in a circular duct.

As illustrated in FIG. 12, flow control device 5 of the present invention may be constructed to fit into a standard circular air duct of, say, 4" or 6" or 8" diameter. With this configuration, register grill 4 may be removed to expose register box 3 and a flow control device 5 inserted within the interior of the duct 2. Flow control device 5 may be placed within the air duct by means of a friction fit, adhesive, Velcro, or other affixing means. Register grill 4 may be reattached, thus not changing the exterior decorative style. In the preferred embodiment, no wires need be attached or connected to the air vent of the present invention, as the signals to open or restrict air flow will be sent to the communication interface means by use of wireless signals. Some installations may require that communications device 40 be attached to the front of register grill 4 using a simple extension cable.

Figure 13:
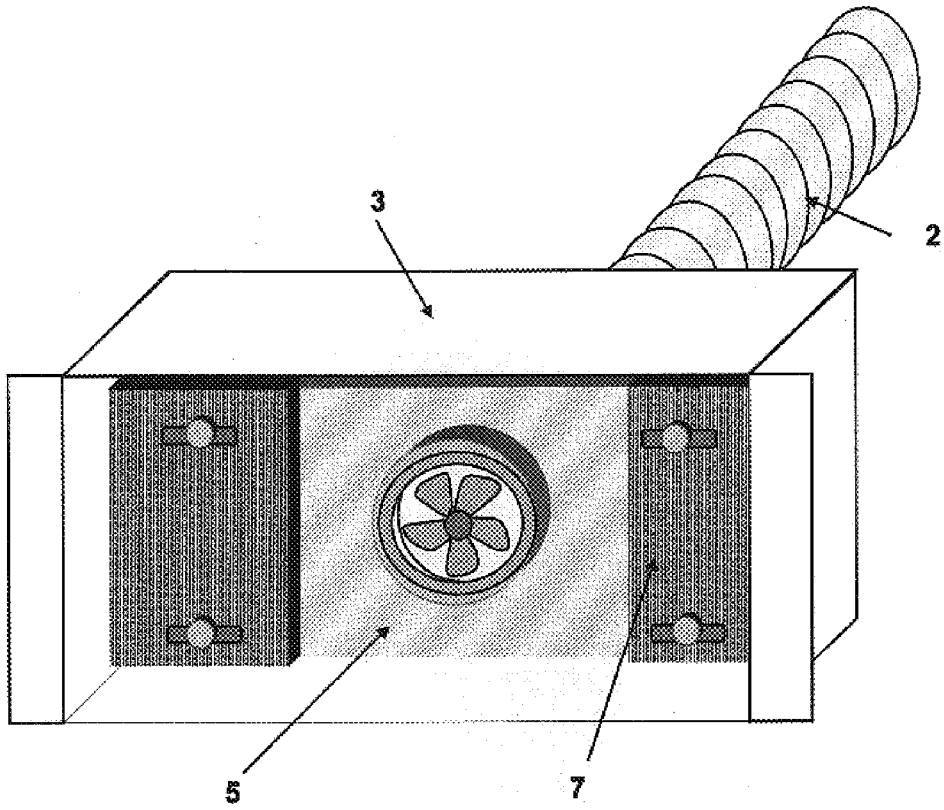
FIG. 13 shows a 3-D perspective view illustrating a method of installing the present invention in a register box.

As illustrated in FIG. 13, adjustable size bracket 7 is used to affix flow control device 5 within register box 3. This method of installation may be used in the event there are obstructions in duct 2 near its termination into register box 3.

Figure 14:
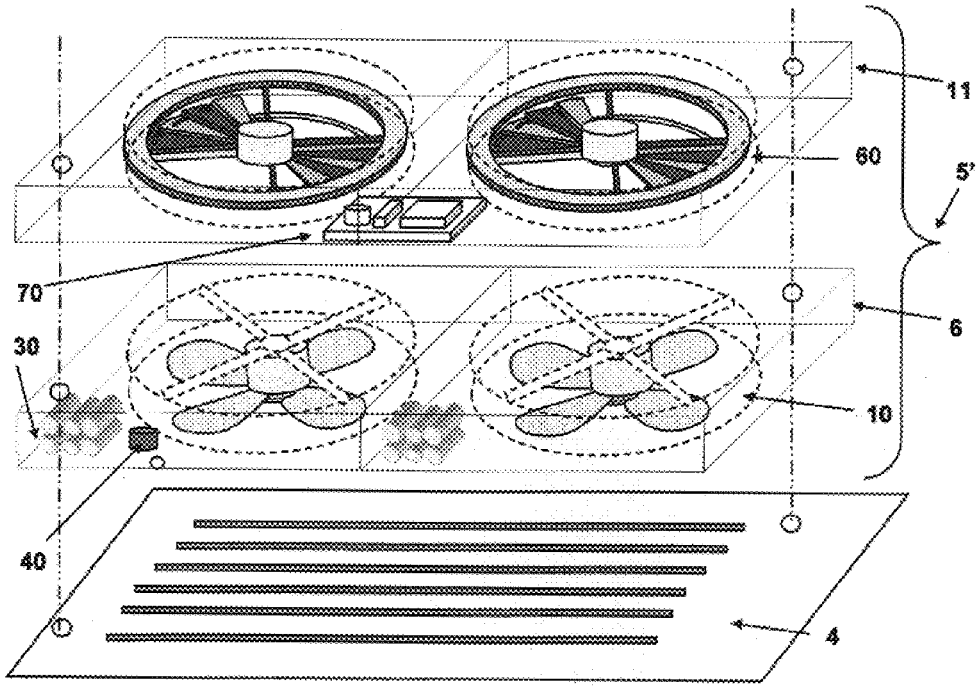
FIG. 14 shows a 3-D exploded perspective view illustrating a method of installing the present invention in a register grill.
Figure 15:
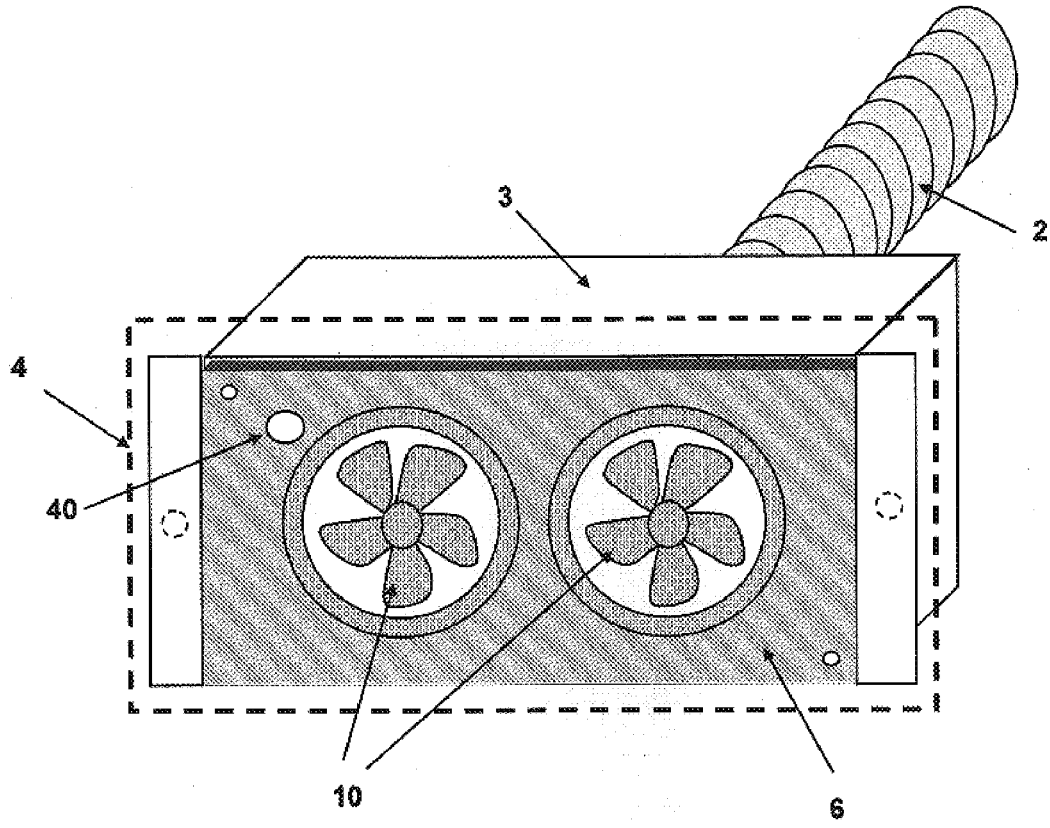
FIG. 15 shows a 3-D perspective view illustrating a method of installing the present invention in a register grill as placed into a register box.

A third method of installation is illustrated in FIG. 14. Flow control device 5' is affixed to register grill 4. Flow control device 5' has all the same components as the duct version, arranged in a different geometry. Grill mounting bracket 6 is affixed to the interior side of register grill 4. One or more parallel rotating structures 10 are mounted side by side into grill mounting bracket 6, effectively covering the vent area of register grill 4. Power storage 30 is placed within grill mounting bracket 6. Petal valve bracket 11 is affixed to grill mounting bracket 6. One or more petal valves 60 are mounted side by side into petal valve bracket 11 such that they are axially oriented coincident to rotating structures 10. Once mounted in register box 3, FIG. 15 illustrates grill mounting bracket 6 with communications device 40 and rotating structures 10 of flow control device 5', with register grill 4 not shown for clarity.

Figure 16:
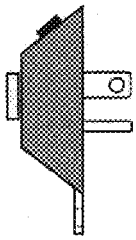
FIG. 16 shows a side view illustrating an AC line network embodiment of sensor-network module 8'.
Figure 17:
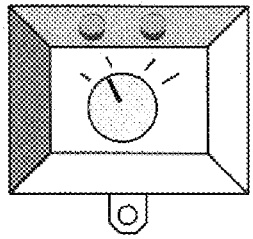
FIG. 17 shows a front view illustrating an AC line network embodiment of sensor-network module 8'.
Figure 18:
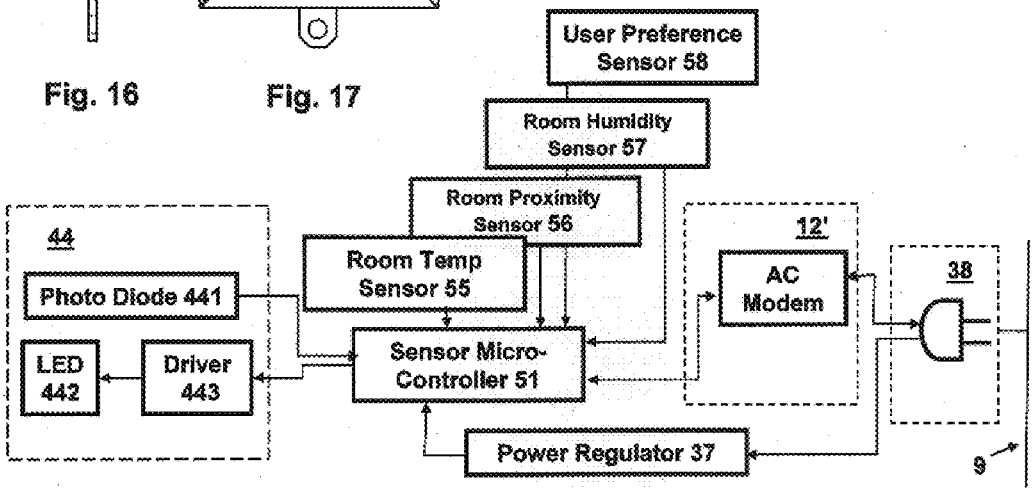
FIG. 18 shows a schematic view illustrating an AC line network embodiment of sensor-network module 8'.

FIGS. 16, 17, and 18 illustrate one embodiment of sensor-network module 8'. FIG. 16 illustrates a side view of sensor-network module 8' and FIG. 17 is the front view. Sensor-network module 8' in this embodiment is designed to be installed in a standard AC outlet. FIG. 18 shows the specific internal workings of sensor-network module 8' embodiment. In this embodiment, sensor communications device 44 includes infra-red photo diode 441 and infra-red LED 442, driven by driver 443. In this embodiment, network interface 12 includes an AC modem 1201. AC modem 1201 is connected to AC line network 9, which also serves as power source 38. This allows sensor-network module 8' to provide all the capabilities of the embodiment shown in FIG. 11.

Figure 19:
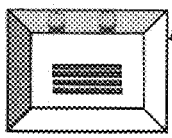
FIG. 19 shows a front view illustrating an inductive coupler AC line network embodiment of sensor-network module 8'.
Figure 20:
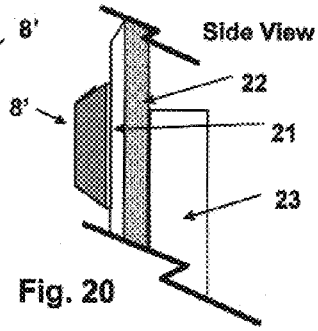
FIG. 20 shows a side view illustrating an inductive coupler AC line network embodiment of sensor-network module 8'.
Figure 21:
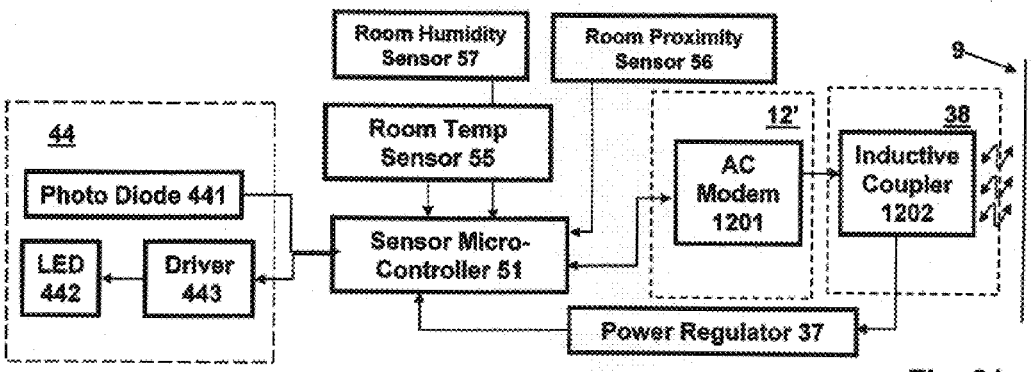
FIG. 21 shows a schematic view illustrating an inductive coupler AC line network embodiment of sensor-network module 8'.

FIGS. 19, 20, and 21 illustrate another embodiment of sensor-network module 8'. FIG. 19 illustrates a front view of sensor-network module 8' and FIG. 20 is a side view showing sensor-network module 8' affixed to a switch plate 21 on wall 22 adjacent to electrical box 23. Such a configuration is typical of a standard wall mounted light switch. FIG. 21 shows the specific internal workings of sensor-network module 8' embodiment. In this embodiment, network interface 12 includes an AC modem 1201. AC modem 1201 is connected to inductive coupler 1202, which also serves as power source 38. Inductive coupler 1202 may be any of a number of devices capable of exchanging electrical energy and communication signals by inductive means. This allows sensor-network module 8' to provide all the capabilities of the embodiment shown in FIG. 11.

Operation

Figure 22:
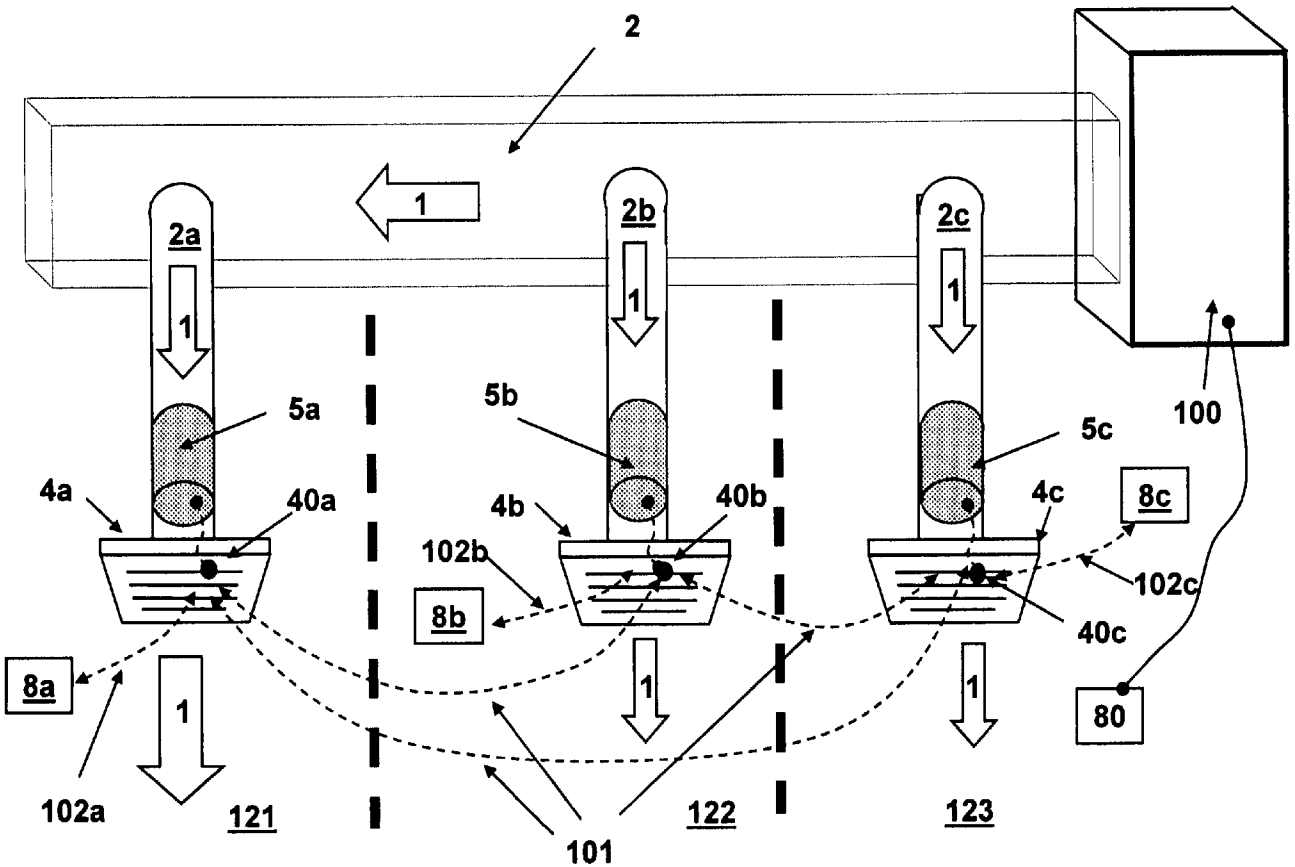
FIG. 22 shows a diagrammatic view illustrating operation of a plurality of flow control devices 5 with environmental control unit 100 in the on state.
Figure 23:
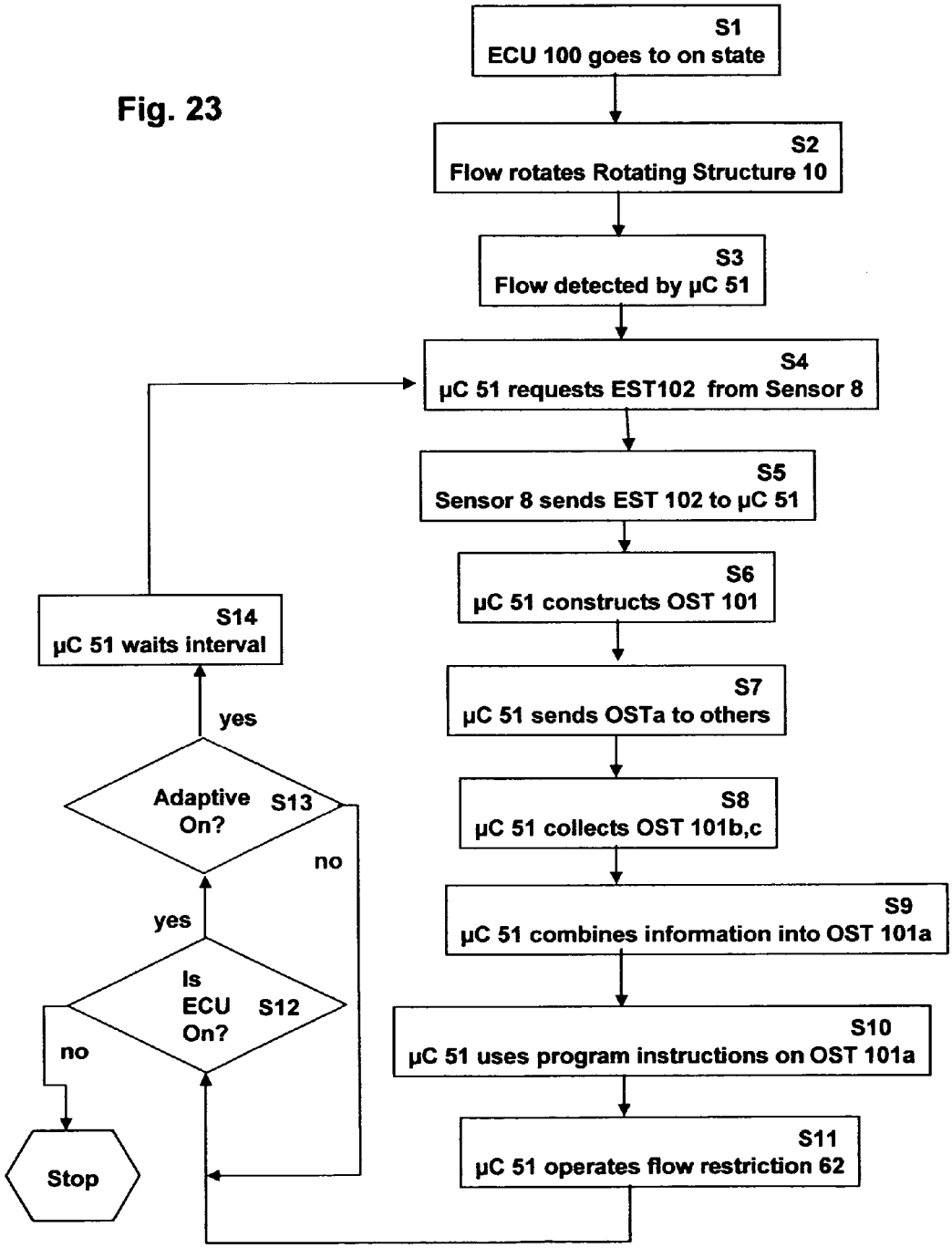
FIG. 23 shows a flow chart view illustrating the operation of the present invention.

FIG. 22 illustrates an example of the operation of a plurality of flow control devices 5*a*, 5*b*, 5*c* in operation while environmental control system 100 is in the on state. FIG. 23 illustrates the operation as steps in flow chart form. Each flow control device 5*a*, 5*b*, 5*c* receives its respective environmental status table 102*a*, 102*b*, 102*c* from their respective sensors 8*a*, 8*b*, 8*c* representing the local environmental conditions of their respective rooms 121, 122, 123. In this example, a user in room 121 desires a different environmental condition, such as temperature, than a user in either room 122 or room 123. In order to accomplish this goal, different amounts of air flow need to be delivered to the respective rooms, differing from that which would normally have been delivered by environmental control unit 100 through ductwork 2.

Figure 25:
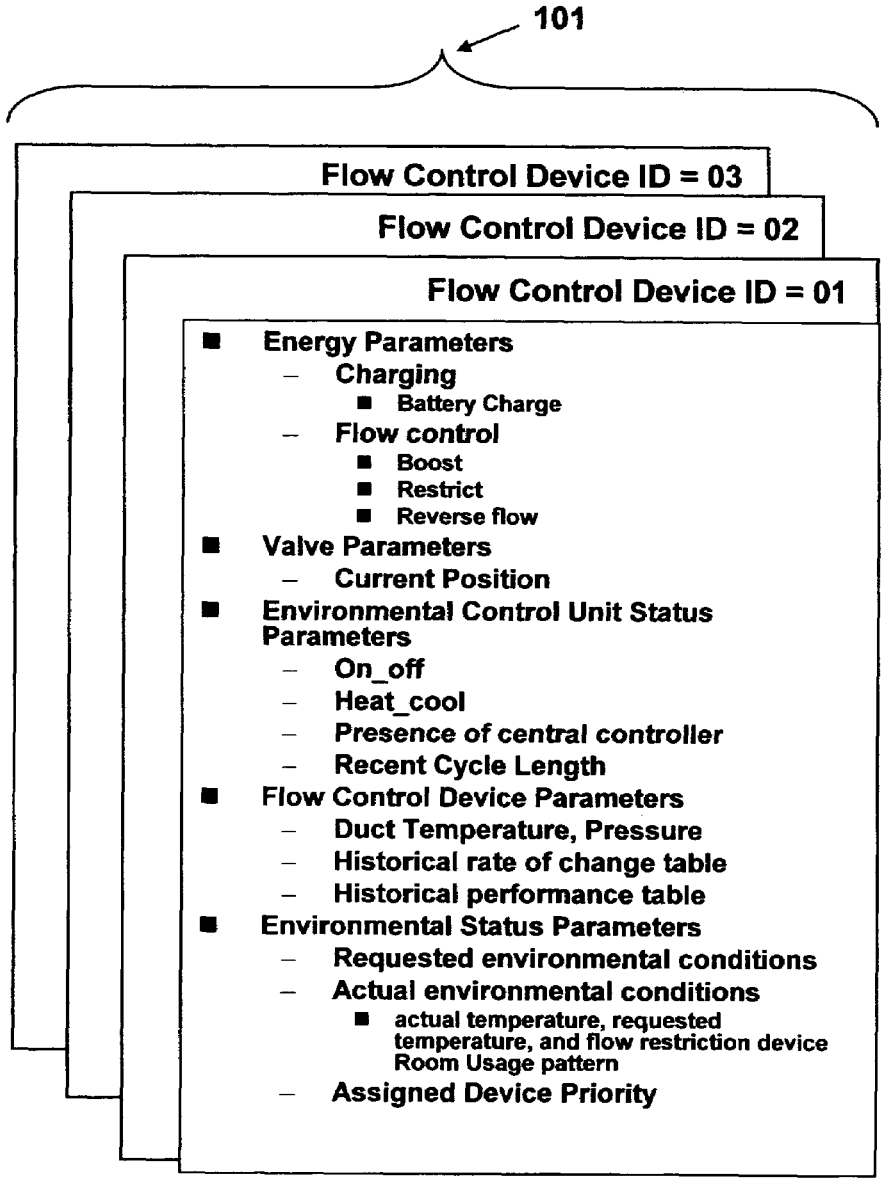
FIG. 25 shows a tabular view of operations status table 101.

In this example of operation, respective user preference sensors 58 (FIG. 10) with sensors 8*a*, 8*b*, and 8*c* are set to the desired environmental conditions for each respective room. Central controller 80 signals environmental control unit 100 to transition to the on state, step S1 of FIG. 23. Environmental control unit 100 causes air flow 1 to flow through ductwork 2, 2*a*, 2*b*, and 2*c* and into flow control devices 5*a*, 5*b*, and 5*c*. In room 121, air flow 1 causes rotating structure 10 (shown in FIG. 4) of flow control device 5*a* to rotate, step S2, causing generation of electrical energy by motor-dynamo 31 (shown in FIG. 4) which is detected by the microcontroller 50, step S3, by way of analog to digital converter 52 and motor dynamo bus 33. Microcontroller 50 requests, by way of communications device 40, environmental status table 102 from sensor 8*a*, steps S4 and S5. Microcontroller 50 constructs operational status table 101 (as will be detailed in FIG. 25), containing data reflecting the environmental conditions of room 121 and internal data reflecting the operation of flow control device 5*a*, for instance, the temperature within flow restriction device 5*a* as measured by temperature sensor 54, step S6. Microcontroller 50 sends operational status table 101*a* to flow control devices 5*b* and 5*c* by way of communications driver 41 and communications device 40, step S7. In a like manner, flow control devices 5*b* and 5*c* also transmit their respective operational status tables to the other flow control devices. Microcontroller 50 of flow control device 5*a* receives, by way of communications device 40, operational table 101*b* of flow control device 5*b*, step S8. Microcontroller 50 adds the information contained in operational table 101*b* to its operational table 101*a*. In a like manner, Microcontroller 50 of flow control device 5*a* receives, by way of communications device 40, operational table 101*c* of flow control device 5*c*. Microcontroller 50 adds the information contained in operational table 101*c* to its operational table 101*a*, step S9.

In this manner, each respective flow control device 5*a*, 5*b*, 5*c* now has complete knowledge of the operational status parameters of all flow control devices. Using this information contained in operational status table 101, each flow control device uses microcontroller 50, acting upon its program instructions, to determine the appropriate flow restriction response it should implement, step S10. Continuing with the current example of operation, for each flow restriction device, operational status table 101 includes the actual temperature, requested temperature, and flow restriction device temperature as measured by temperature sensor 54.

By restricting air flow in one or more flow control devices, more air flow is available to other ducts in the system. This provides the ability to use flow restriction means to boost the amount of air flow into certain rooms. A boost in the amount of air flow serves to decrease the time needed to bring those rooms to their respective desired environmental condition.

Continuing with this operational example, program instructions use the actual temperature, requested temperature, and flow restriction device temperature to determine whether to invoke a means to restrict flow. Two conditions may exist. In the first condition, if the actual temperature is greater than the requested temperature and the flow restriction device temperature is less than the actual temperature, or the actual temperature is less than the requested temperature and the flow restriction device temperature is greater than the actual temperature, then microcontroller 50 calculates the amount of flow restriction to invoke. This amount of flow restriction to invoke may be zero to maximum possible flow restriction and is calculated according to the program instructions.

There are a great variety of ways to calculate the amount of flow restriction to invoke. In one typical embodiment, an inverse linear relationship between the difference between the actual temperature and the requested temperature (delta T) and the amount of flow restriction to invoke can be used. More complex calculations can be implemented. For example, piecewise linear equations, linear optimization techniques, or continuous functions may be applied.

In the second condition, if the actual temperature is less than or equal to the requested temperature or the flow restriction device temperature is greater than or equal to the actual temperature, and the actual temperature is greater than or equal to the requested temperature or the flow restriction device temperature is less than or equal to the actual temperature, then microcontroller 50 sets the amount of flow restriction to invoke to the maximum possible flow restriction. In this example, these same program instructions apply without regard to whether environmental control unit 100 is heating or cooling.

As shown in FIG. 4, microcontroller 50 signals flow restriction control 62, step S11. Flow restriction control 62 actuates stepper motor 64. Stepper motor 64 closes petal valve 60. Depending upon the embodiment of flow restriction device installed, other flow restriction means are possible. If the flow control device comprises both a petal valve and rotating structure, or dual rotating structures, then the multiple devices can be used additively to create additional restriction. Microcontroller 50 may signal load control 36 to extract electrical energy from motor-dynamo bus 33 which in turn causes motor-dynamo 31 to use rotating structure 10 to extract electrical energy from the kinetic energy of the air flow. The extraction of electrical energy from the kinetic energy causes a reduced flow to the room. Load control 36 absorbs the collected electrical energy, typically by using a resistive load.

In the event microcontroller 50 detects depletion of power storage 30, by way of power bus 39 and analog to digital converter 52, then microcontroller 50 invokes means to replenish power by signaling power manager 35 to draw electrical energy from motor-dynamo bus 33, which in turn causes motor-dynamo 31 to use rotating structure 10 to extract electrical energy from the kinetic energy of the air flow. Power manager 35, in turn, deposits the electrical energy to power storage 30. The extraction of electrical energy from the kinetic energy also causes reduced flow to the room. Typically, replenishment of power storage 30 has precedence over the amount of flow restriction to invoke.

At this point, the system is fully functional and the flow control devices may continue unchanged until the environmental control unit returns to the off state, causing an improved performance of the overall system, step S12. The entire process, steps S1 to S12, repeats itself when the environmental control unit returns to the on state.

Adaptive Embodiment

A greater measure of improvement of the performance of the flow control devices can be implemented by adding adaptive control means. If adaptive means are turned on, step S13, the program instructions are allowed to repeat. At appropriate intervals, step S14, microcontroller 50 of flow control device 5*a* repeats the above described sequence, steps S4 to S13. The intervals between repetitions may be governed by several means, including changes in environmental status table 102, operational status table 101, timed interval, delay interval, and updated operational status tables from other flow control devices. Microcontroller 50 requests, by way of communications device 40, environmental status table 102 from sensor 8*a*. Microcontroller 50 sends operational status table 101*a* to flow control devices 5*b* and 5*c* by way of communications driver 41 and communications device 40. Microcontroller 50 updates operational status table 101*a*, containing data reflecting the environmental conditions of room 121 and internal data reflecting the operation of flow control device 5*a*. Microcontroller 50 sends operational status table 101*a* to flow control devices 5*b* and 5*c* by way of communications driver 41 and communications device 40. In a like manner, flow control devices 5*b* and 5*c* also transmit their respective operational status tables to the other flow control devices. Microcontroller 50 of flow control device 5*a* receives, by way of communications device 40, operational table 101*b* of flow control device 5*b*. Microcontroller 51 updates the information contained in operational table 101*b* to its operational table 101*a*. In a like manner, Microcontroller 50 of flow control device 5*a* receives, by way of communications device 40, operational table 101*c* of flow control device 5*c*. Microcontroller 50 uses the information contained in operational table 101*c* to update its operational table 101*a*.

In this manner, each respective flow control device 5*a*, 5*b*, 5*c* again has complete knowledge of the operational status parameters of all flow control devices. These parameters may have changed owing to changes in the amount of flow restriction at each flow control device. Once again, using this information contained in operational status table 101, each flow control device uses microcontroller 50, acting upon its program instructions, to determine the appropriate flow restriction response it should now implement. By repeating the above described sequence at appropriate intervals, flow control devices 5*a*, 5*b*, 5*c* is able to adapt the amount of flow restriction to changes in user requests, environmental conditions, unequal distribution of air flow in the ducts. The program instructions themselves may be adaptively modified, which effectuates a complex adaptive system.

The adaptive process is repeated as long as environmental control system 100 is in the on state.

In this example, only three parameters from operational status table 101 have been used by the program instructions, namely: actual temperature, requested temperature, and flow restriction device temperature. The relative differences in these parameters between the flow control devices provide the information required to determine the amount of flow restriction to invoke. Other embodiments of these adaptive means are possible by using other environmental and operational parameters as well as more sophisticated program instructions. They include, but are not limited to: humidity, proximity, priority, air duct pressure, historical observations, time, day, date, and environmental control unit status.

In a further operational example, room 123 is closer to environmental control system 100, receiving more air flow from ductwork 2 than room 121, due to shorter distance and therefore less resistance to air flow in ductwork 2. Room 123 being closer to environmental control system 100 will typically receive greater air flow. It is likely that room 123 which contains central controller 80 will reach the desired temperature set on central controller 80 and shut environmental control unit 100 to the off state well before room 121 reaches the same temperature. This will occur even if rooms 121, 122, and 123 have similar heat sources and sinks. Flow control devices 5*a*, 5*b*, 5*c* adapt to this situation by dynamically adjusting their respective flow restriction using the parameters available in operating status table 101.

Operation During Failure

The present invention eliminates the need for a central controller or central processing unit to achieve overall environmental control goals. When one or more flow control devices 5 fail, operational status table 101 will not have parameter updates from those failed flow control devices. In a similar failure situation, communications means between flow control devices may partially or totally fail, resulting in operational status table 101 not having parameter updates from those flow control devices that are not in communication. The functional flow control devices still continue to operate independently, or partially independently, towards achieving the overall environmental control goals. Flow restriction decisions will be made from the remaining information available. If necessary, a single functioning flow control device may continue to operate to meet environmental control goals for the room it serves. Therefore, the present invention is not subject to the risk complete system failure caused by a failed central controller, central processing unit, or failed communications network.

Operational Status Table Embodiment

Operational control table 101 includes the parameters necessary to execute the previously described embodiments, such as temperature, requested temperature, and flow restriction device temperature. Operational control table 101 also includes parameters which enable more advanced adaptive program instructions. For example, by tracking whether a given room reaches its goal during an on state cycle of the environmental control unit, the parameters associated with the inverse linear relationship between the difference between the actual temperature and the requested temperature (delta T) and the amount of flow restriction can be adjusted.

In another example, in order to protect the environmental control unit from damage due to excessive restriction of flow, the duct air pressure upstream of the flow control device may be calculated knowing the temperature and the rotation rate of the rotating structure, as deduced from the potential voltage presented by motor-dynamo upon the motor-dynamo bus. Operational status table 101 makes the duct air pressure at each flow control device available to all flow control devices. Each flow control device may review these duct air pressures and adapt its flow restriction in accordance with these duct air pressures.

In any particular installation, users have different needs for the various rooms. This can be expressed as a priority parameter. For example, a room may be unused for a period of time. A user assigns a lower priority to those rooms which are not in use to allow greater operating latitude to those flow control devices which are serving these other rooms which are in use. Alternatively, a proximity sensor detects the use or non use of the room which may be used by the program instructions to appropriately control the environmental conditions of that room.

Figure 24:
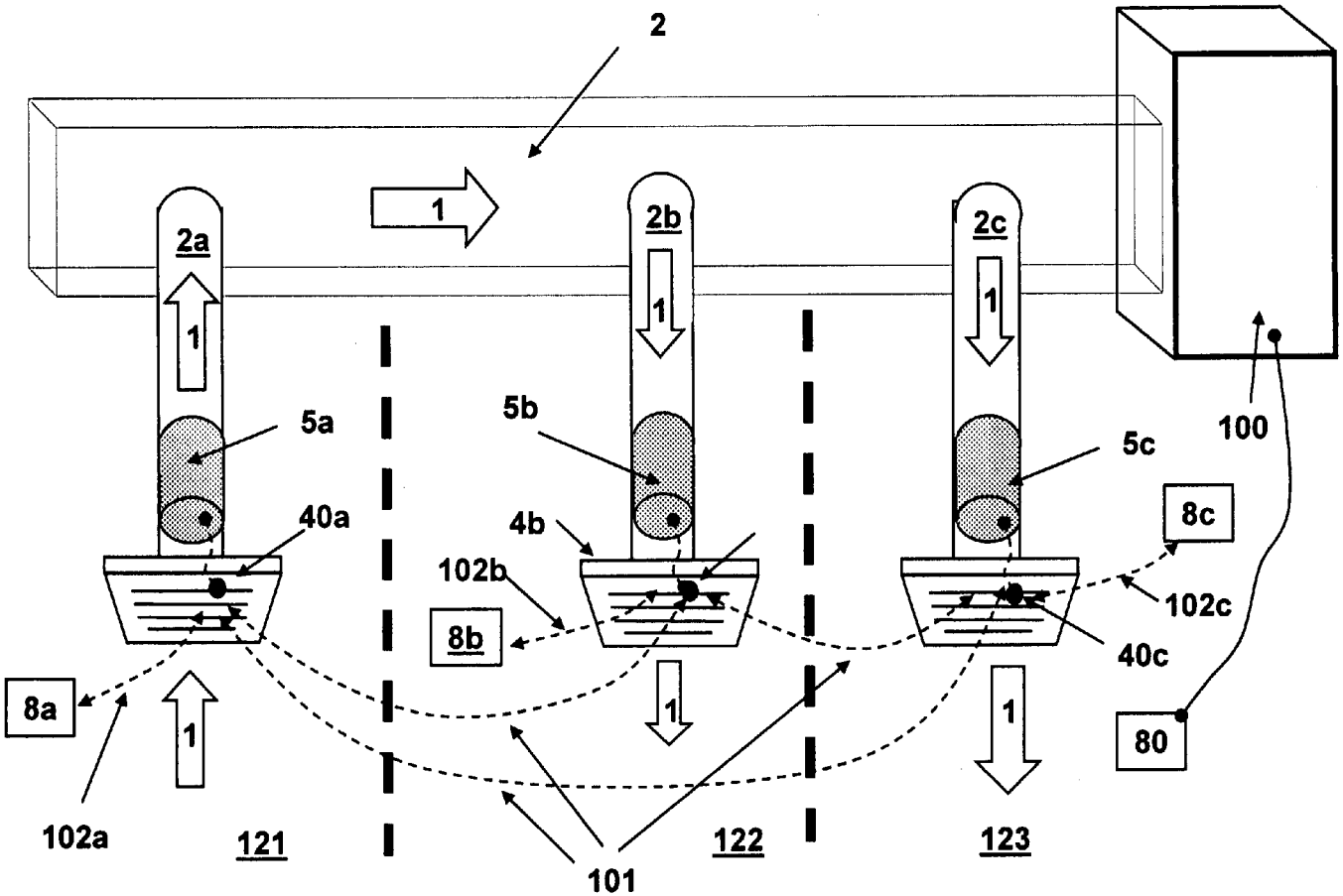
FIG. 24 shows a diagrammatic view illustrating operation of a plurality of flow control devices 5 with environmental control unit 100 in the off state.

FIG. 24 illustrates a typical embodiment of operational status table 101. Operational status table 101 is structured so as to contain one or more data elements for each flow control device in the system. Operational status table 101 may be constructed as a collection of data objects, one data object for each flow control device. Each object of operational status table 101 may include a variety of data elements, which may also be called parameters. Classes of parameters include Energy parameters, Valve parameters, Environmental Control Unit Status Parameters, Flow Control Device Parameters, and Environmental Status Parameters.

Energy Parameters relate to the status of rotating structure 10 and the energy state of flow control device 5. The microcontroller of the flow control device adapts the program instructions to account for the values of these parameters. Examples of energy parameters include: charging, battery charge, and flow control. The charging parameter is a flag that the rotating structure is currently supplying power to recharge the battery. If the flag is set, this signals that the flow control device will be limited in its ability to restrict flow. Maintaining power source charge is almost always given precedence over other functions of the rotating structure is instances where a battery is used for the power source. The battery charge parameter is a numeric value which represents the current charge level of the power source. This allows the various systems to estimate the time remaining to full charge, at which time more restriction will be available to the system. In the event a wired source is used for the power source, battery charge is set to maximum. The 'flow control' parameter is a multi-valued parameter which describes the current use of the rotating structures in the flow control device for activities other than charging and the magnitude of those activities. In the event of multiple rotating structures, the variables have indexes which allow the program instructions to access the values sequentially, i.e. Rotation (1), Rotation (2). Rotation (n)=(x, magnitude) where n is the index to the specific structure, and x is a numeric flag where:

1=Boost mode
2=Restriction mode
3=Reverse flow mode

Flow control devices calculate total restriction any device is producing in its leg of the system as well as the overall effects of that restriction on other legs of the system using the flow control flag and current position data described below.

Valve Parameters relate to the status of any passive restriction used in the flow control device. An example of a valve parameter is the 'current position' parameter In the event the flow control device is equipped with a petal valve or other passive flow restriction device, the 'current position' parameter represents the current amount of restriction which is being provided. In many embodiments this variable is calibrated to actual flow restriction percentage. Flow control devices assess the full system response of their individual and collective actions based on the value of the 'current position' and the 'flow control' parameter.

Environmental Control Unit Status Parameters relate to the status of any environmental control units in the system. Examples of Environmental Control Unit Status Parameters include: On_off, Heat_cool_dry, 'presence of central controller', and 'recent cycle length'. The On_off parameter is a flag which represent the current state of the environmental control unit. The flow control unit switches operation instructions based on the value of this flag. The Heat_cool_dry parameter is multi-value flag which represents the current mode of the environmental control unit. In most installations this flag represents whether the environmental control unit is supplying air which is warmer, cooler, wetter or drier than the room being serviced. In certain operating scenarios, flow control units alter their actions based on the value of this flag. The flag is set by the flow control device by comparing the values of its internal sensors and the corresponding sensor 8 in the room being serviced. The 'presence of central controller' parameter is a single value flag which is used to alert the flow control devices in the installation of which room or rooms have central controllers. This enables such rooms to be treated differently. In one embodiment for example, rooms which have the central controller will purposely delay satisfying their user environmental preference to allow other rooms in the system time to reach their goals. In another example, in the case where the environmental unit is in the off state, flow control devices push air back through the duct system towards the central controller using the value of this flag. The 'recent cycle length' parameter contains the length of time that the environmental control unit remained in the on state during the last several on states. The flow control devices use this parameter to predict the total available air conditioning that may be provided during the next on state in order to improve flow restriction performance.

Flow Control Device Parameters relate to internal measurements and calculations taken by the flow control device. Examples of Flow Control Device Parameters include: type of device, duct temperature, duct pressure, historical rate of change table, and historical performance table. The type of device parameter is a multi-valued parameter which represents the type and capabilities of a specific flow control device. This may include the version or model number of the physical device, the version number of the program instructions, and the adaptive code mode being used. A flow control device may have one or more types of restriction devices or rotating structures, which are represented by the values of this parameter. Flow control devices calculate the range of possible responses to a given situation by using this flag. The duct temperature and duct pressure is a dual-valued parameter which contains the current temperature in the flow control device and the upstream pressure in the ductwork. The flow control device calculates the upstream pressure using a measured energy output of the rotational structure by way of the motor-dynamo, motor dynamo bus and analog to digital converter and the air temperature to correct for density effects. This parameter is important in preventing the collective group of flow control devices from overly restricting flow in the ductwork and causing damage to the environmental control unit. The historical rate of change table is an object which is used to store parameters relating to how rapidly the environmental changes occurred in the room due to operating parameters of the flow control device. The program instructions use this data to adapt the operating strategy for the device in a specific room. This provides a means for devices to sense the relative differences in the rooms serviced and adjust operating parameters appropriately. The historical performance table is an object which is used to store parameters relating to how well the flow control device was able to satisfy past user environmental requests. Using knowledge of past performance the flow control device alters its program instructions. This object captures changes in heat sources and sinks in a given room such as the effect of afternoon sun. Although a given flow control device may have had no problem reaching user environmental requests in the morning, the added influx of heat will cause the flow control device to lag in the afternoon and the program instructions detect this change through this object and response accordingly.

Environmental Status Parameters relate to data received from environmental status table 102. Examples of Environmental Status Parameters include: requested environmental conditions, actual environmental conditions, and assigned device priority. The requested environmental conditions parameter contains the requested environmental parameters set by the user. This is used by the flow control devices as a primary input to determine operating parameters using program instructions. An example is the requested temperature. The actual environmental conditions parameter contains various readings as measured by sensor 8, for example data gathered from room temperature sensor 55, room proximity sensor 56 or room humidity sensor 57. Using program instructions, the flow control device compares this parameter to the requested environmental conditions to determine action. The assigned device priority parameter captures the user's planned use of a given room. The flow control device selects the appropriate action using this variable. In a typical embodiment this parameter would have values such as:

1=Heavy use room
2=Occasional use room
3=Timed use room
4=Unused room

Boost Embodiment

In the preceding embodiments, flow control devices restricted air flow. In an alternative embodiment, rotating structure 10 is operated in such a manner as to boost the air flow through the flow control device. Microcontroller 50 signals power manager 35 to transfer electrical energy from power bus 39 to motor-dynamo bus 33, causing rotating structure 10 to accelerate propulsion of air into the room. Program instructions may account for boost capability by treating boost capability as a negative amount of flow restriction.

Reversing Flow Embodiment

In another embodiment, the flow control devices operate during periods when the environmental control unit is in the off state. Referring to FIG. 24, in this example of operation, room 121 is not at the desired environmental condition while at the same time room 123 is at its desired environmental condition. Central controller 80 does not signal environmental control unit 100 to transition to the on state. Flow control device 5*a* serving room 121 activates rotating structure 10 in the reverse direction, thereby reverse flowing air through ducts 2 and 2*a*. Air flow 1 exhaust into duct 2*c*, entering room 123 and altering the environmental condition of room 123. In the case of room 121 being too hot, the withdrawal of air from room 121 serves to cause cooler air from other locations to enter room 121. Additionally, air from duct 2 which is typically too hot enters room 123 causing the environmental condition of room 123 to no longer be at its desired environmental condition. Central controller 80 thereby signals environmental control unit 100 to transition to the on state.

Flow control device 5*b* in room 122 detects air flow caused by the operation of flow control device 5*a*. From information received in operational status table 101, flow control device 5*b* joins in by restricting or even reversing air flow. Flow control device 5*c* in room 123 also detects air flow caused by the operation of flow control devices 5*a* and 5*b*. From information received in operational table 101, flow control device 5*c* joins in by boosting flow into room 123. In this way, the flow control devices act cooperatively to cause central controller 80 to signal environmental control unit 100 to the on state.

Even if flow control device 5*b* does not activate upon detection of air flow, the sending of operational status table 101 from flow control device 5*a* serves to activate flow control device 5*b*.

Although the description above contains many specifications, these should not be construed as limiting the scope of the invention but as merely providing illustrations of some of the presently preferred embodiments of this present invention. Persons skilled in the art will understand that the method and apparatus described herein may be practiced, including but not limited to, the embodiments described. Further, it should be understood that the invention is not to be unduly limited to the foregoing which has been set forth for illustrative purposes. Various modifications and alternatives will be apparent to those skilled in the art without departing from the true scope of the invention, as defined in the following claims. While there has been illustrated and described particular embodiments of the present invention, it will be appreciated that numerous changes and modifications will occur to those skilled in the art, and it is intended in the appended claims to cover those changes and modifications which fall within the true spirit and scope of the present invention.

What is claimed is:

1. A flow control device for controlling air flow through a duct in a duct system, the flow control device in communication with at least one other flow control device in the duct system, the flow control device comprising:

an air flow control member configured to selectively control air flow through the flow control device;

a controller member configured to autonomously control the air flow control member;

a sensor member operatively attached to the controller member, wherein the sensor member is configured to sense an environmental condition;

a power member for supplying power to the flow control device; and a communication device disposed in the flow control device and operatively attached to the controller member, the communication device is configured to directly communicate with the at least one other flow control device in the duct system, wherein the communication device is configured to receive data directly from the at least one other flow control device and wherein the controller member is configured to analyze the received data and alter the control of the air flow control member accordingly.

2. The flow control device of claim 1, further comprising a temperature sensor connected to the controller member.

3. The flow control device of claim 1, wherein the at least one other flow control device comprises an air flow control member, a controller member, a sensor member, a power member, and a communication device.

4. The flow control device of claim 3, wherein each flow control device interacts with other flow control devices in order to control the air flow through the duct system.

5. The flow control device of claim 3, wherein the controller member in each flow control device is capable of controlling the air flow control member based upon data from the communication device.

6. The flow control device of claim 1, wherein the communication device is configured to communicate with the at least one other flow control device via an acoustic signal.

7. The flow control device of claim 1, wherein the communication device is configured to communicate with the at least one other flow control device via a RF signal.

8. The flow control device of claim 1, wherein the communication device is configured to communicate with the at least one other flow control device via an infrared signal.

9. The flow control device of claim 1, wherein the communication device is capable of automatically detecting and establishing communication upon detection of at least one other flow control device in the duct system.

10. The flow control device of claim 1, wherein the communication device is configured to share information with the at least one other flow control device.

11. The flow control device of claim 1, wherein the flow control member is configured to retard air flow through the flow control device.

12. The flow control device of claim 11, wherein the flow control device comprises a fan retardation member.

13. The flow control device of claim 11, wherein the flow control device comprises an array of fans.

14. The flow control device of claim 1, wherein the flow control member is configured to enhance air flow through the flow control device.

15. The flow control device of claim 14, wherein the flow control member comprises a fan or a blower.

16. The flow control device of claim 14, wherein the flow control member comprises a generator configured to enhance or retard air flow through the flow control device.

17. The flow control device of claim 1, wherein the flow control member is configured to selectively control air flow through the flow control device by enhancing air flow or retarding air flow based on the environmental condition.

18. The flow control device of claim 1, wherein the controller member comprises an internal program memory.

19. The flow control device of claim 1, wherein the controller member is capable of controlling the air flow control member based upon the environmental condition.

20. The flow control device of claim 1, wherein the duct is in communication with a defined location.

21. The flow control device of claim 20, wherein the sensor member is configured to sense the environmental condition in the defined location and the environmental condition includes temperature, pressure, humidity or combination thereof.

22. The flow control device of claim 20, wherein the sensor member is configured to sense the environmental condition in the duct and the environmental condition includes temperature, pressure, air flow or combination thereof.

23. The flow control device of claim 20, wherein the sensor member is remotely disposed in the defined location.

24. The flow control device of claim 1, wherein the power member comprises a replaceable battery.

25. The flow control device of claim 1, wherein the power member is wired to a power source.

26. The flow control device of claim 1, wherein the power member is configured to generate energy utilizing air flow through the flow control device.

27. The flow control device of claim 26, wherein the power member comprises capacitor storage.

28. The flow control device of claim 1, wherein the controller member is programmed with adaptive processing means.

29. The flow control device of claim 1, wherein the communication device further comprises means to relay information to other devices.

30. The flow control device of claim 1, wherein the communication device further sends an environmental control unit command.

31. The flow control device of claim 1, wherein the sensor is remotely disposed relative to the controller member and the sensor includes a sensor communications device, a sensor device, a sensor microcontroller connected to the sensor communications device and the sensor device, and a power source.

32. The flow control device of claim 31, wherein the sensor device is comprised of at least one device selected from the group consisting of room temperature sensor, room proximity sensor, room humidity sensor, and user preference sensor.

33. The flow control device of claim 31, wherein the sensor further comprises means to communicate an operational status table to a second sensor in communication with a second flow control device.

34. The flow control device of claim 33, wherein the communications means of the sensor comprises a network interface.

35. The flow control device of claim 34, wherein the network interface is an AC line modem.

36. The flow control device of claim 35, wherein the AC line modem is inductively coupled to AC power mains.

37. The flow control device of claim 1, wherein the sensor further comprises a means to wirelessly communicate with other devices in a local area of the sensor, relaying information from the other local area devices to a wired line network.

38. The flow control device of claim 1, further comprising an adjustable bracket means whereby the flow control device may be installed in a register box.

39. The flow control device of claim 1, wherein the flow control device is affixed to a register grill.

40. The flow control device of claim 1, wherein the communication device is configured to send data directly to the at least one other flow control device.

41. The flow control device of claim 40, wherein the at least one other flow control device is capable of receiving the data, analyzing the received data and altering the air flow through the at least one other flow control device accordingly.

42. A method of controlling air flow through a duct system, the method comprising:

placing at least a first flow control device and a second flow control device in the duct system, each flow control device comprising:

an air flow control member configured to selectively control air flow through the flow control device;

a controller member configured to autonomously control the air flow control member;

a sensor member operatively attached to the controller member, wherein the sensor member is configured to sense an environmental condition;

a power member for supplying power to the flow control device;

a communication member disposed in the flow control device;

communicating data directly from the second flow control device to the first flow control device; and analyzing the received data in the first flow control device and altering the control of the air flow control member in the flow control device accordingly, as a result of the data analyzation, thereby controlling the air flow through the duct system.

43. The method of claim 42, wherein the data communicated between flow control devices is via the communication member in each flow control device.

44. The method of claim 42, wherein the controller member in each air flow control device is capable of utilizing the data to autonomously operate the air flow control device.

45. The method of claim 42, further comprising optimizing the air flow through the duct system by utilizing data communicated between the flow control devices.

46. The method of claim 42, further comprising optimizing the air flow through the duct system by an autonomous decision process within each flow control device.

47. The method of claim 46, wherein the air flow is optimized by adaptive programming of the controller member.

48. The method of claim 46, wherein the air flow is optimized by the controller member utilizing an operational status table.

49. The method of claim 46, wherein the air flow is optimized by the controller member utilizing a preprogrammed set of instructions.

50. The method of claim 46, further comprising generating energy for the flow control device by utilizing the air flow through the duct system.

51. The method of claim 42, further comprising optimizing the air flow through the duct system to prevent damage to an environment system.

52. The method of claim 42, further comprising optimizing the air flow through the duct system to enhance user comfort.

53. The method of claim 42, further including sending data from the first flow control device to the second flow control device.

54. The method of claim 53, further including analyzing the received data and altering the control of an air flow control member in the second flow control device accordingly.

55. A flow control device for controlling air flow through a duct in a duct system, the flow control device in communication with at least one other flow control device in the duct system the flow control device comprising:

an air flow control member configured to selectively control air flow through the flow control device;

a controller member configured to autonomously control the air flow control member;

a power member for supplying power to the flow control device; and a communication device disposed in the flow control device and operatively attached to the controller member, the communication device is configured to receive data directly from the at least one other flow control device and wherein the controller member is configured to analyze the received data and alter the control of the air flow control member accordingly.

56. The flow control device of claim 55, wherein the communication device is configured to send data directly to the at least one other flow control device.

57. The flow control device of claim 56, wherein the at least one other flow control device is capable of receiving the data, analyzing the received data and altering the air flow through the at least one other flow control device accordingly.

* * * * *